US009668542B2

(12) United States Patent
Lawless

(10) Patent No.: US 9,668,542 B2
(45) Date of Patent: Jun. 6, 2017

(54) SOLE STRUCTURE INCLUDING SIPES

(71) Applicant: NIKE, Inc., Beaverton, OR (US)

(72) Inventor: Deborah L. Lawless, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/826,879

(22) Filed: Aug. 14, 2015

(65) Prior Publication Data

US 2017/0042288 A1 Feb. 16, 2017

(51) Int. Cl.

| | |
|---|---|
| ***A43B 13/00*** | (2006.01) |
| ***A43B 13/22*** | (2006.01) |
| ***A43B 13/14*** | (2006.01) |

(52) U.S. Cl.

CPC ..... *A43B 13/223* (2013.01); *A43B 13/141* (2013.01)

(58) Field of Classification Search

CPC ..... A43B 13/00; A43B 13/141
USPC ..... 36/12, 103, 25 R, 59 C; D2/959, 953
See application file for complete search history.

(56) References Cited

U.S. PATENT DOCUMENTS

| | | | | |
|---|---|---|---|---|
| 503,062 | A | 8/1893 | Norwood | |
| 1,343,450 | A | 6/1920 | Haskell | |
| 1,733,733 | A | 10/1929 | Hess | |
| D90,057 | S * | 5/1933 | Van Cleef | 36/59 C |
| 2,155,166 | A * | 4/1939 | Kraft | A43B 13/223 36/32 R |
| D115,636 | S * | 7/1939 | Sperry | 36/59 C |
| 2,211,509 | A | 8/1940 | Lumbard | |
| 2,251,468 | A | 8/1941 | Smith | |
| 2,363,995 | A | 11/1944 | Rollman et al. | |
| 2,432,533 | A | 12/1947 | Margolin | |
| 2,963,722 | A | 12/1960 | Stix | |
| 3,626,532 | A | 12/1971 | Smith | |
| 3,662,478 | A | 5/1972 | Schwab | |
| 3,745,600 | A | 7/1973 | Rubico et al. | |
| 3,757,436 | A | 9/1973 | Winkler et al. | |
| 4,050,108 | A | 9/1977 | Londner | |
| 4,272,850 | A | 6/1981 | Rule | |
| 4,340,626 | A | 7/1982 | Rudy | |
| 4,484,398 | A | 11/1984 | Goodwin et al. | |
| 4,668,557 | A | 5/1987 | Lakes | |
| 4,756,098 | A | 7/1988 | Boggia | |

(Continued)

FOREIGN PATENT DOCUMENTS

| | | |
|---|---|---|
| GB | 2 147 792 A | 5/1985 |
| GB | 2 455 167 A | 6/2009 |

(Continued)

OTHER PUBLICATIONS

International Search Report and Written Opinion mailed Dec. 4, 2014 in PCT/US2014/052038.

(Continued)

*Primary Examiner* — Marie Bays
(74) *Attorney, Agent, or Firm* — Quinn Law Group, PLLC

(57) ABSTRACT

An article of footwear may include a sole structure with a plurality of sipes. The plurality of sipes may extend from the forefoot region to the heel region. Additionally, the plurality of sipes may extend across the sole structure from a medial edge toward the lateral side and from a lateral edge toward the medial side. Further, the sole structure may include longitudinal sipes that extend longitudinally along the sole structure.

20 Claims, 13 Drawing Sheets

(56) References Cited

U.S. PATENT DOCUMENTS

D302,352 S * 7/1989 Austin ..... D2/959
4,858,340 A 8/1989 Pasternak
4,899,412 A 2/1990 Ganon
4,967,492 A 11/1990 Rosen
4,999,931 A 3/1991 Vermeulen
5,012,597 A 5/1991 Thomasson
5,060,402 A 10/1991 Rosen
D339,459 S 9/1993 Yoshikawa et al.
D344,170 S 2/1994 Acoff
5,469,639 A 11/1995 Sessa
5,718,064 A 2/1998 Pyle
5,813,146 A 9/1998 Gutkowski et al.
5,918,338 A 7/1999 Wong
D413,714 S 9/1999 Challant
D414,317 S * 9/1999 Lubart ..... D2/951
D420,786 S 2/2000 Ramer et al.
6,065,230 A * 5/2000 James ..... A43B 3/0057 36/25 R
6,151,804 A 11/2000 Hieblinger
6,178,662 B1 1/2001 Legatzke
D437,106 S 2/2001 Cagner
6,202,325 B1 * 3/2001 Kim ..... A43B 3/105 36/11.5
6,226,896 B1 5/2001 Friton
D446,915 S * 8/2001 Cockrell ..... D2/959
D446,916 S * 8/2001 Cockrell ..... D2/947
D447,326 S * 9/2001 Cockrell ..... D2/959
D453,989 S 3/2002 Cagner
6,357,146 B1 3/2002 Wordsworth et al.
6,412,593 B1 7/2002 Jones
D463,901 S * 10/2002 Adams ..... D2/951
6,487,795 B1 12/2002 Ellis, III
6,564,476 B1 5/2003 Hernandez
6,574,889 B2 6/2003 Cagner
D483,934 S * 12/2003 Adams ..... D2/957
D487,614 S 3/2004 Le
D488,916 S 4/2004 McClaskie
6,862,820 B2 3/2005 Farys et al.
D509,650 S * 9/2005 Burg ..... D2/953
D527,172 S * 8/2006 Burg ..... D2/953
D530,894 S * 10/2006 Cockrell ..... D2/951
D531,788 S * 11/2006 Rittberg ..... D2/953
7,132,032 B2 11/2006 Tawney et al.
7,160,621 B2 1/2007 Chaudhari et al.
7,252,870 B2 8/2007 Anderson et al.
7,254,906 B2 8/2007 Morris et al.
7,287,343 B2 10/2007 Healy
7,310,894 B1 12/2007 Schwarzman et al.
D571,543 S 6/2008 Sungadi
7,455,567 B2 11/2008 Bentham et al.
7,487,602 B2 2/2009 Berger et al.
7,546,698 B2 6/2009 Meschter
7,574,818 B2 8/2009 Meschter
D614,382 S 4/2010 Grenet et al.
7,770,307 B2 8/2010 Meschter
7,814,852 B2 10/2010 Meschter
7,827,703 B2 11/2010 Geer et al.
7,870,681 B2 1/2011 Meschter
7,870,682 B2 1/2011 Meschter et al.
8,002,879 B2 8/2011 Hook
D653,844 S 2/2012 Smith
8,122,616 B2 2/2012 Meschter et al.
8,132,340 B2 3/2012 Meschter
8,146,272 B2 * 4/2012 Dukovic ..... A43B 13/22 36/103
8,186,078 B2 5/2012 Avar et al.
8,196,316 B2 6/2012 Cook et al.
8,220,072 B2 7/2012 Dodd
8,225,530 B2 7/2012 Sokolowski et al.
8,266,827 B2 9/2012 Dojan et al.
8,276,294 B2 10/2012 Polegato Moretti
8,277,719 B2 10/2012 Alderson et al.
8,312,645 B2 11/2012 Dojan et al.
8,322,050 B2 12/2012 Lubart
8,343,404 B2 1/2013 Meli et al.
8,388,791 B2 3/2013 Dojan et al.
8,490,299 B2 7/2013 Dua et al.
8,505,219 B2 * 8/2013 Avar ..... A43B 5/06 36/102
8,516,723 B2 8/2013 Ferrigan et al.
8,544,197 B2 10/2013 Spanks et al.
8,631,589 B2 1/2014 Dojan
8,661,564 B2 3/2014 Dodd
8,732,982 B2 5/2014 Sullivan et al.
D707,934 S 7/2014 Petrie
D716,027 S 10/2014 Kirschner
8,863,412 B2 * 10/2014 Dekovic ..... A43B 13/22 36/103
D717,034 S 11/2014 Bramani
8,961,733 B2 2/2015 Dodd
2004/0181972 A1 9/2004 Csorba
2006/0059717 A1 3/2006 Mitchell
2007/0213838 A1 9/2007 Hengelmolen
2007/0240333 A1 10/2007 Le et al.
2008/0011021 A1 1/2008 Starbuck et al.
2008/0216357 A1 9/2008 Fogg et al.
2008/0250673 A1 10/2008 Andrews et al.
2008/0289214 A1 11/2008 Aveni
2009/0064536 A1 3/2009 Klassen et al.
2009/0064540 A1 3/2009 Sokolowski et al.
2009/0119820 A1 5/2009 Bentham et al.
2009/0183392 A1 7/2009 Shane
2009/0276933 A1 11/2009 Dodd
2009/0293314 A1 * 12/2009 Dekovic ..... A43B 13/141 36/103
2009/0307932 A1 12/2009 Kirby et al.
2010/0029796 A1 2/2010 Alderson et al.
2010/0043255 A1 2/2010 Trevino
2010/0095551 A1 4/2010 Gupta et al.
2010/0126041 A1 5/2010 Francis
2010/0139122 A1 6/2010 Zanatta
2010/0170117 A1 7/2010 Kim
2010/0236098 A1 9/2010 Morgan
2010/0299965 A1 * 12/2010 Avar ..... A43B 5/06 36/102
2011/0099845 A1 5/2011 Miller
2011/0119956 A1 5/2011 Borel et al.
2011/0168313 A1 7/2011 Ma et al.
2011/0247237 A1 10/2011 Jara et al.
2011/0247240 A1 10/2011 Eder et al.
2012/0021167 A1 1/2012 Plant
2012/0023686 A1 2/2012 Huffa et al.
2012/0117826 A1 5/2012 Jarvis
2012/0124861 A1 5/2012 Losani
2012/0124865 A1 5/2012 Opie et al.
2012/0129416 A1 5/2012 Anand et al.
2012/0159810 A1 6/2012 Klassen
2012/0174432 A1 7/2012 Peyton
2012/0181896 A1 7/2012 Kornbluh et al.
2012/0198720 A1 8/2012 Farris et al.
2012/0210607 A1 8/2012 Avar et al.
2012/0233878 A1 9/2012 Hazenberg et al.
2012/0233885 A1 * 9/2012 Shaffer ..... A43B 13/20 36/103
2012/0266492 A1 10/2012 Youngs et al.
2012/0272550 A1 11/2012 Parce
2012/0315456 A1 12/2012 Scarpa et al.
2013/0000152 A1 1/2013 Cooper et al.
2013/0055596 A1 * 3/2013 Wan ..... A43B 13/141 36/25 R
2013/0071583 A1 3/2013 Evans et al.
2013/0081305 A1 4/2013 Byrne
2013/0104428 A1 5/2013 O'Brien et al.
2013/0152428 A1 6/2013 Bishop et al.
2013/0160324 A1 6/2013 Peyton et al.
2013/0160328 A1 6/2013 Hatfield et al.
2013/0219636 A1 8/2013 Dojan et al.
2013/0239444 A1 9/2013 Polegato Moretti
2013/0276333 A1 10/2013 Wawrousek et al.
2013/0284732 A1 10/2013 Van Schaftingen
2013/0340288 A1 12/2013 Baker et al.
2014/0041261 A1 * 2/2014 Walker ..... A43B 3/0057 36/25 R
2014/0053311 A1 2/2014 Nordstrom et al.

(56) References Cited

U.S. PATENT DOCUMENTS

| | | | | |
|---|---|---|---|---|
| 2014/0053312 | A1 | 2/2014 | Nordstrom et al. | |
| 2014/0059734 | A1 | 3/2014 | Toronjo | |
| 2014/0090271 | A1 | 4/2014 | Hoffer et al. | |
| 2014/0101816 | A1 | 4/2014 | Toronjo | |
| 2014/0157631 | A1 | 6/2014 | Dodd | |
| 2014/0165427 | A1 | 6/2014 | Molyneux et al. | |
| 2014/0173938 | A1 | 6/2014 | Beye et al. | |
| 2014/0237850 | A1 | 8/2014 | Hull | |
| 2014/0259769 | A1 | 9/2014 | Bjornson et al. | |
| 2014/0260281 | A1 | 9/2014 | Innes | |
| 2015/0075033 | A1 | 3/2015 | Cross et al. | |
| 2015/0075034 | A1 | 3/2015 | Cross et al. | |
| 2015/0359294 | A1* | 12/2015 | VanHook ..... | A43B 13/16 36/25 R |
| 2016/0007681 | A1* | 1/2016 | Langvin ..... | A43B 5/00 36/103 |

FOREIGN PATENT DOCUMENTS

| | | | |
|---|---|---|---|
| GB | 2 463 446 | A | 3/2010 |
| JP | 2005-143637 | A | 6/2005 |
| WO | 03/022085 | A2 | 3/2003 |
| WO | 2007052054 | A1 | 5/2007 |
| WO | 2012171911 | A1 | 12/2012 |
| WO | 2015041796 | A1 | 3/2015 |

OTHER PUBLICATIONS

Office Action mailed Mar. 26, 2015 in U.S. Appl. No. 14/030,002.
International Search Report and Written Opinion mailed Oct. 14, 2015 in PCT/US2015/038958.
International Search Report and Written Opinion mailed Nov. 17, 2015 in PCT/US2015/040523.

* cited by examiner

SOLE STRUCTURE INCLUDING SIPES

BACKGROUND

The present embodiments relate generally to articles of footwear, and in particular to articles of footwear with uppers and sole structures.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one aspect, the embodiments provide a sole structure that includes a forefoot region, a midfoot region, and a heel region. The sole structure has a lateral edge and a medial edge, and the sole structure has a toe edge and a heel edge. The sole structure includes a first plurality of sipes and a second plurality of sipes. The first plurality of sipes extends from the medial edge of the sole structure toward the lateral edge of the sole structure. Each sipe of the first plurality of sipes extends from a first position along a medial edge to a second position between the medial edge and the lateral edge. The first position is located closer to the heel edge than the second position. The second plurality of sipes extends from the lateral edge of the sole structure toward the medial edge of the sole structure. Each sipe of the second plurality of sipes extends from a third position along the lateral edge to a fourth position between the lateral edge and the medial edge. The third position is located closer to the heel edge than the fourth position. The first plurality of sipes being located in the forefoot region, the midfoot region, and the heel region. The second plurality of sipes being located in the forefoot region, the midfoot region, and the heel region.

In another aspect, an embodiment provides a sole structure that includes a forefoot region, a midfoot region, and a heel region. The sole structure includes a first edge and a second edge, and the sole structure further has a toe edge and a heel edge. The sole structure further includes a first plurality of sipes, a second plurality of sipes, and a third plurality of sipes. The first plurality of sipes extend from the first edge of the sole structure toward the second edge of the sole structure. The first plurality of sipes have a first slope with respect to a longitudinal axis and a lateral axis. The longitudinal axis extends from the toe edge to the heel edge. The lateral axis extends from the first edge to the second edge. The second plurality of sipes extend from the second edge of the sole structure toward the first edge of the sole structure. The second plurality of sipes have a second slope with respect to the longitudinal axis. The second slope being different than the first slope. The first plurality of sipes intersect with the second plurality of sipes at a first intersection. The third plurality of sipes extends from the forefoot region to the heel region. At least one of the third plurality of sipes intersects the first plurality of sipes and the second plurality of sipes at the first intersection.

In another aspect, an embodiment provides a sole structure that includes a forefoot region, a midfoot region, and a heel region. The sole structure has a lateral edge and a medial edge as well as a toe edge and a heel edge. The sole structure includes a first plurality of sipes, a second plurality of sipes, and a third plurality of sipes. The first plurality of sipes intersects the second plurality of sipes and the third plurality of sipes. The first plurality of sipes, the second plurality of sipes, and the third plurality of sipes form a plurality of sole elements in the sole structure. At least one recessed portion is formed in the plurality of sole elements. The recessed portion has a first leg, a second leg, a third leg, and a central portion. At least one of the sipes of the first plurality of sipes, at least one of the sipes of the second plurality of sipes, and at least one of the sipes of the third plurality of sipes intersects in the central portion of the recessed portion. At least one of the sipes of the first plurality of sipes intersects the first leg. At least one of the sipes of the second plurality of sipes intersects the second leg. At least one of the sipes of the third plurality of sipes intersects the third leg. The first plurality of sipes extend from the medial edge of the sole structure toward the lateral edge of the sole structure. The second plurality of sipes extend from the lateral edge of the sole structure toward the medial edge of the sole structure.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
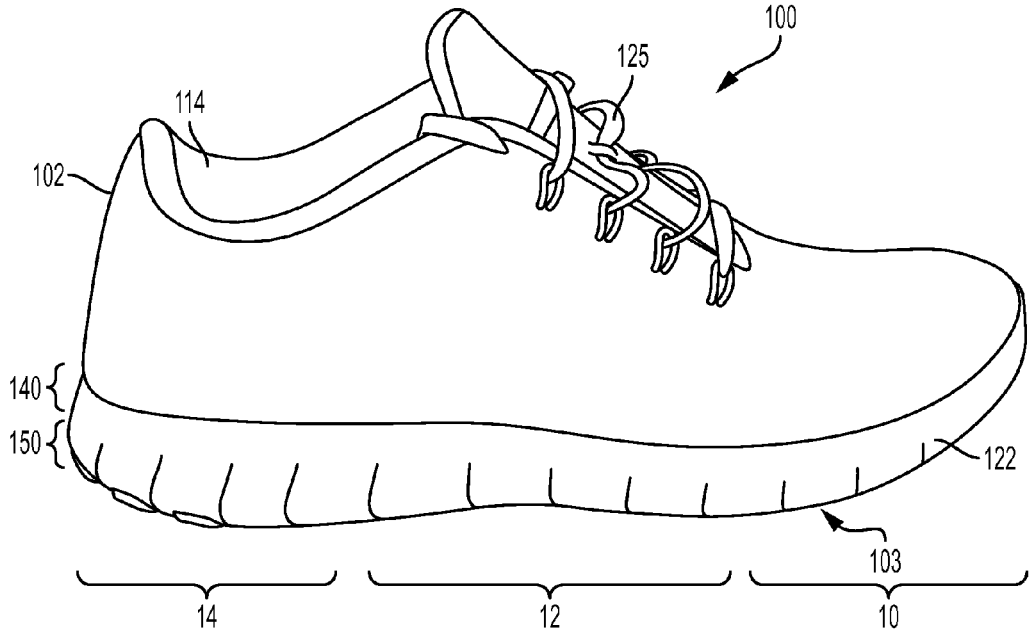
FIG. 1 is a schematic side view of an embodiment of an article of footwear.

FIG. 1 is an isometric view of an embodiment of an article of footwear 100. In the exemplary embodiment, article of footwear 100 has the form of an athletic shoe. However, in other embodiments, the provisions discussed herein for article of footwear 100 could be incorporated into various other kinds of footwear including, but not limited to, basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports-related footwear, including, but not limited to, slippers, sandals, high-heeled footwear, and loafers.

For purposes of clarity, the following detailed description discusses the features of article of footwear 100, also referred to simply as article 100. However, it will be understood that other embodiments may incorporate a corresponding article of footwear (e.g., a left article of footwear when article 100 is a right article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing subcomponents of an article of footwear (e.g., directions and/or portions of an inner sole component, a midsole component, an outer sole component, an upper, or any other components).

For consistency and convenience, directional adjectives are employed throughout this detailed description corresponding to the illustrated embodiments. The term "longitudinal" as used throughout this detailed description and in the claims refers to a direction oriented along a length of a component (e.g., an upper or sole component). In some cases, a longitudinal direction may be parallel to a longitudinal axis that extends between a forefoot portion and a heel portion of the component. Also, the term "lateral" as used throughout this detailed description and in the claims refers to a direction oriented along a width of a component. In some cases, a lateral direction may be parallel to a lateral axis that extends between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, a vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure, and/or an outer sole structure.

Article 100 may be characterized by a number of different regions or portions. For example, article 100 could include a forefoot portion, midfoot portion, heel portion, and an ankle portion. Referring to FIG. 1, article 100 may be divided into forefoot region 10, midfoot region 12, and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. Article 100 may also include an ankle portion, which may also be referred to as a cuff portion that is associated with the ankle of a user. In addition, article 100 may include lateral side 16 and medial side 18 (see FIG. 2). In particular, lateral side 16 and medial side 18 may be opposing sides of article 100. Furthermore, both lateral side 16 and medial side 18 may extend through forefoot region 10, midfoot region 12, heel region 14, and the ankle portion. Forefoot region 10, midfoot region 12, heel region 14, lateral side 16, and medial side 18 are not intended to demarcate precise areas of article 100. Rather, forefoot region 10, midfoot region 12, heel region 14, lateral side 16, and medial side 18 are intended to represent general areas of article 100 that provide a frame of reference during the following discussion. Moreover, components of article 100 could likewise comprise corresponding portions.

Generally, upper 102 may be any type of upper. In particular, upper 102 may have any design, shape, size, and/or color. For example, in embodiments where article 100 is a basketball shoe, upper 102 could be a high-top upper that is shaped to provide high support on an ankle. In embodiments where article 100 is a running shoe, upper 102 could be a low-top upper.

In some embodiments, upper 102 includes opening 114 that provides entry for the foot into an interior cavity of upper 102. In some embodiments, upper 102 may also include a tongue that provides cushioning and support across the instep of the foot. Some embodiments may include fastening provisions, including, but not limited to, laces, cables, straps, buttons, zippers as well as any other provisions known in the art for fastening articles. In some embodiments, lace 125 may be applied at a fastening region of upper 102.

Some embodiments may include uppers that extend beneath the foot, thereby providing 360-degree coverage at some regions of the foot. However, other embodiments need not include uppers that extend beneath the foot. In other embodiments, for example, an upper could have a lower periphery joined with a strobel, sole structure, and/or sock liner.

An upper could be formed from a variety of different manufacturing techniques, resulting in various kinds of upper structures. For example, in some embodiments, an upper could have a braided construction, a knitted (e.g., warp-knitted) construction, or some other woven construction. In an exemplary embodiment, upper 102 may be a knitted upper.

Figure 2:
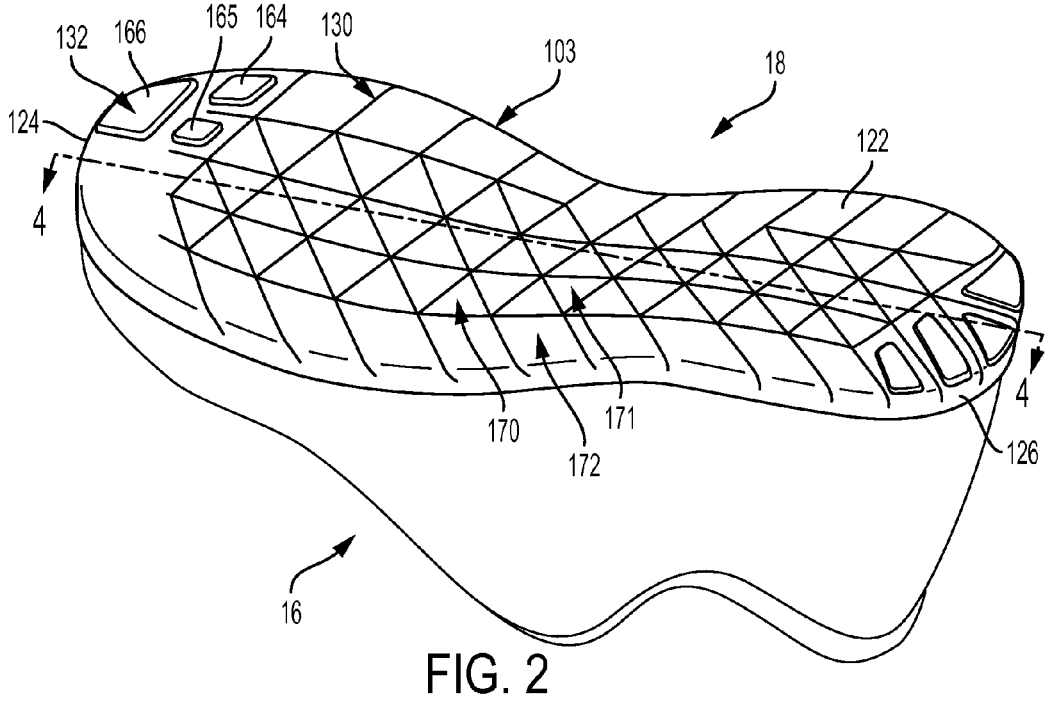
FIG. 2 is a bottom isometric view of an embodiment of an article of footwear.
Figure 3:
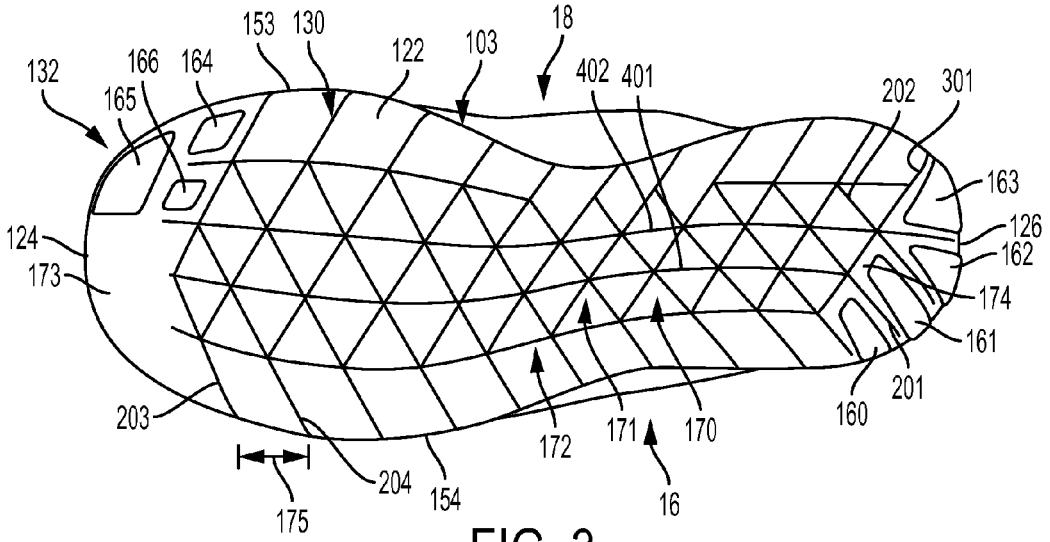
FIG. 3 is a bottom view of an embodiment of a sole structure.

FIGS. 2 and 3 illustrate a bottom view of sole structure 103. In some embodiments, sole structure 103 may be configured to provide traction for article 100. In addition to providing traction, sole structure 103 may attenuate ground reaction forces when compressed between the foot and the ground during walking, running, or other ambulatory activities. Sole structure 103 may provide a durable, wear-resistant component for attenuating ground reaction forces and absorbing energy as article 100 impacts the ground. The configuration of sole structure 103 may vary significantly in different embodiments to include a variety of conventional or non-conventional structures. In some cases, the configuration of sole structure 103 can be configured according to one or more types of ground surfaces on which sole structure 103 may be used. Examples of ground surfaces include, but are not limited to, natural turf, synthetic turf, dirt, hardwood flooring, as well as other surfaces.

Sole structure 103 is secured to upper 102 and extends between the foot and the ground when article 100 is worn. In different embodiments, sole structure 103 may include different components. In some embodiments, sole structure 103 may include a midsole component and plurality of outer sole members 132. In some cases, one or more of these components may be optional.

In some embodiments, a midsole component may extend from forefoot region 10 through midfoot region 12 and to heel region 14. In some embodiments, the midsole component may be a continuous, one-piece component that extends from forefoot region 10 to heel region 14. In other embodiments, the midsole component may include multiple pieces or may include a gap or space in any of the regions. That is, in some embodiments, the midsole component may be separated into two or more pieces.

In different embodiments, the midsole component may generally incorporate various provisions associated with midsoles. For example, in one embodiment, a midsole component may be formed from a polymer foam material that attenuates ground reaction forces (i.e., provides cushioning) during walking, running, and other ambulatory activities. In various embodiments, midsole components may also include fluid-filled chambers, plates, moderators, or other elements that further attenuate forces, enhance stability, or influence the motions of the foot, for example.

In some embodiments, the sole structure may include outer sole members. Specifically, sole structure 103 includes first outer sole member 160, second outer sole member 161, third outer sole member 162, fourth outer sole member 163, fifth outer sole member 164, sixth outer sole member 165, and seventh outer sole member 166. Although the exemplary embodiment includes seven different outer sole members, other embodiments could include any other number of outer sole members. In another embodiment, for example, only a single outer sole member may be present. In still another embodiment, only two outer sole members may be used. In still another embodiment, only three outer sole members could be used. In still other embodiments, seven or more outer sole members could be used.

Generally, an outer sole member may be configured as a ground-contacting member. In some embodiments, an outer sole member could include properties associated with outsoles, such as durability, wear resistance, and increased traction. In other embodiments, an outer sole member could include properties associated with a midsole, including cushioning, strength, and support. In the exemplary embodiment, the plurality of outer sole members may be configured as outsole-like members that enhance traction with a ground surface while maintaining wear resistance.

In some embodiments, an inner surface of the outer sole members may be disposed against the midsole component. The outer surface of the outer sole members may face outwardly and may be a ground-contacting surface.

In different embodiments, the materials and/or physical properties of an outer sole member could vary. In some embodiments, an outer sole member could have a relatively high coefficient of friction when compared to a midsole component. For example, in an exemplary embodiment, first outer sole member 160 may have a first coefficient of friction with a predetermined material (e.g., wood, laminate, asphalt, concrete, etc.) and a midsole component may have a second coefficient of friction with the same predetermined material. In some embodiments, the first coefficient of friction is different than the second coefficient of friction. In an exemplary embodiment, the first coefficient of friction is greater than the second coefficient of friction, so that first outer sole member 160 provides increased traction (or grip) with the predetermined material in comparison to the midsole component. In at least some embodiments, the predetermined material may be associated with a type of ground surface. For example, the predetermined material could be wood associated with wood flooring on basketball courts. In other embodiments, the predetermined material could be laminate material that may also be associated with some kinds of courts. In still other embodiments, the predetermined material could be asphalt. In still other embodiments, the predetermined material could be concrete.

Likewise, in some embodiments, each of the remaining outer sole members may also have higher coefficients of friction (relative to a given ground surface) than the midsole component. This arrangement may allow a user to brake or make cuts by engaging at least one of the outer sole members with a ground surface. It will be understood that in other embodiments, first outer sole member 160 could have a coefficient of friction equal to or less than the coefficient of friction of the midsole component.

It may be appreciated that the coefficient of friction may change according to ambient conditions such as temperature, velocity, etc. Moreover, the coefficients of friction could be different for dry versus wet conditions. As used herein, the first coefficient of friction and the second coefficient of friction defined for first outer sole member 160 and the midsole component, respectively, may be dry coefficients of friction at standard temperatures and pressures.

Increased friction with a ground surface can be achieved by utilizing materials having higher coefficients of friction and/or by providing surface features that enhance grip with the ground. Such features could include tread elements such as ridges, hemispheric protrusions, cylindrical protrusions as well as other kinds of tread elements.

In different embodiments, the densities of an outer sole member and/or a midsole component could vary. In some embodiments, an outer sole member may have a higher density than a midsole component, thereby allowing for increased durability and wear resistance for the outer sole member. In other embodiments, however, the density of the outer sole member could be equal to the density of the midsole component, or could be less than the density of the midsole component.

Outer sole members could be manufactured from a variety of different materials. Exemplary materials include, but are not limited to, rubber (e.g., carbon rubber or blown rubber), polymers, thermoplastics (e.g., thermoplastic polyurethane), as well as possibly other materials. In contrast, midsole components may generally be manufactured from polyurethane, polyurethane foam, other kinds of foams as well as possibly other materials. In some embodiments, the midsole component may utilize polymer foams. In some embodiments, the midsole component may utilize ethylvinylacetate and polyurethane foam. In still further embodiments, the midsole component may be formed from polyurethane foam having a specific gravity of approximately 0.22. It will be understood that the type of materials for the outer sole members and a midsole component could be selected according to various factors including manufacturing requirements and desired performance characteristics. In an exemplary embodiment, suitable materials for the outer sole members and the midsole component could be selected to ensure the outer sole members have a larger coefficient of friction than the midsole component, especially when these components are in contact with hardwood surfaces, laminate surfaces, asphalt, as well as other surfaces where article 100 may be most commonly used.

In some embodiments, article 100 may be configured to complement the natural motion of the foot during running or other activities. In some embodiments, upper 102 and sole structure 103 may have a structure that cooperatively articulates, flexes, stretches, or otherwise moves to provide an individual with a sensation of natural barefoot running. In contrast to barefoot running, however, sole structure 103 attenuates ground reaction forces and absorbs energy to cushion the foot and decrease the overall stress upon the foot.

In some embodiments, the midsole component includes plurality of sipes 130 that extend along the midsole component. In some embodiments, the sipes of plurality of sipes 130 may extend from lateral side 16 to medial side 18. Additionally, plurality of sipes 130 may extend from heel region 14 to forefoot region 10. In some embodiments, at least some sipes of plurality of sipes 130 may extend from heel edge 126 to toe edge 124. Plurality of sipes 130 may assist in allowing sole structure 103 to bend and twist during use, and additionally, plurality of sipes 130 may allow sole structure 103 to impart the feeling or sensation of barefoot running to a user.

Figure 4:
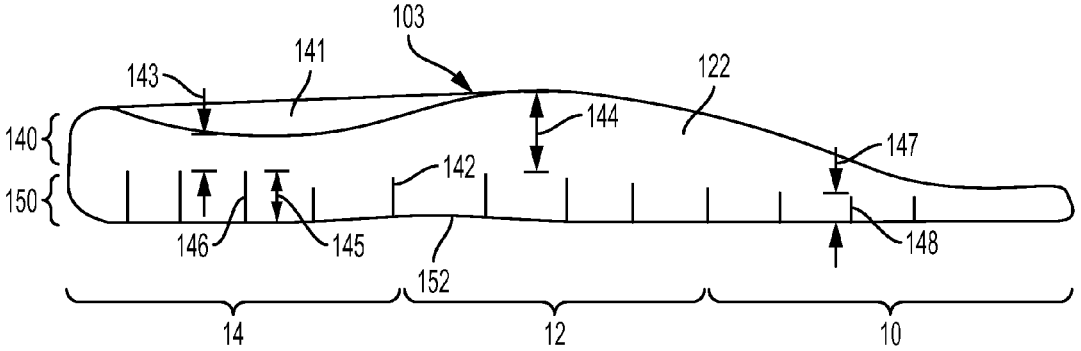
FIG. 4 is a side section view of an embodiment of a sole structure.

Referring particularly to FIG. 4, a cross-section cut of sole structure 103 is depicted. As shown, the midsole component includes connecting portion 140 and siped portion 150. Connecting portion 140 may extend along the length of sole structure 103 from heel region 14 to forefoot region 10. Additionally, connecting portion 140 may have upper surface 141 and lower surface 142, which is opposite upper surface 141. Upper surface 141 may be positioned adjacent to upper 102 and secured to upper 102 or a strobel if present in article 100 as shown in FIG. 1.

Although discussed as including a lower surface, in some embodiments, lower surface 142 is used for description and not necessarily to indicate that connecting portion 140 and siped portion 150 are separate pieces. In some embodiments, siped portion 150 and connecting portion 140 may be formed from a single piece. Lower surface 142 may be used to denote the surface of the midsole component that is located at the end or edge of the sipes. For example, a depth of a sipe may be measured from a ground-contacting surface 152 to lower surface 142.

In some embodiments, the thickness of connecting portion 140 may vary along the length of sole structure 103. As shown, the thickness of connecting portion 140 is defined as the distance between upper surface 141 and lower surface 142. In some embodiments, connecting portion 140 may be thicker in heel region 14 than in forefoot region 10. In other embodiments, connecting portion 140 may be thicker in forefoot region 10 than in heel region 14. In still further embodiments, the thickness of connecting portion 140 may remain relatively consistent from heel region 14 to forefoot region 10. As shown, dimension 143 depicts the thickness of connecting portion 140 in heel region 14. In comparison, dimension 144 depicts the thickness of connecting portion 140 in midfoot region 12. As shown, dimension 144 is larger than dimension 143. As such, connecting portion 140 is thicker in midfoot region 12 than in heel region 14.

The thickness of connecting portion 140 may affect the flexibility of sole structure 103. In general, areas where connecting portion 140 is larger or thicker, sole structure 103 may have decreased flexibility. In contrast, areas of sole structure 103 where connecting portion 140 is smaller or thinner may have greater flexibility.

In some embodiments, the depth of a sipe may be varied along the length of sole structure 103. For example, dimension 145 extends from ground-contacting surface 152 to lower surface 142. Dimension 145, therefore, measures the height or depth of sipe 146. Dimension 147 measures the depth of sipe 148 located in forefoot region 10. As shown, dimension 147 is smaller than dimension 145. Therefore, sipe 148 is larger or deeper than sipe 146.

In some embodiments, the length or height of sipes may be used to adjust or influence the flexibility of sole structure 103. In general, areas of sole structure 103 that include deeper or thicker sipes may be more flexible that areas of sole structure 103 that include thinner sipes. Additionally, by changing the thickness of connecting portion 140 and siped portion 150, the flexibility of sole structure 103 may be affected or altered throughout the length of sole structure 103. For example, in a sole structure with constant height or thickness, a larger sipe may cause connecting portion 140 to be thinner. The larger sipe and thinner connecting portion 140 may cause sole structure 103 to have increased flexibility at that location. Similarly, a sole structure with constant height or thickness may have increased stiffness in areas that include a smaller sipe. The smaller sipe may cause connecting portion 140 to be thicker and, therefore, influence the flexibility of the sole structure at that location.

Referring now to FIGS. 2 and 3, sole structure 103 may have a particular layout or pattern of sipes that extend along sole structure 103. As shown, plurality of sipes 130 extends from medial edge 153 and lateral edge 154 as well as from heel edge 126. In other embodiments, plurality of sipes 130 may additionally extend from toe edge 124. As shown, in some embodiments, plurality of sipes 130 extends longitudinally along sole structure 103 as well as laterally along sole structure 103. The particular layout of sipes forms or defines sole elements.

In some embodiments, sole elements extend throughout sole structure 103 within siped portion 150. As shown in FIGS. 2 and 3, sole elements 170 are shaped by plurality of sipes 130 within siped portion 150. Sole elements 170 may be further separated into central sole elements 171 and peripheral sole elements 172. Central sole elements 171 and peripheral sole elements 172 may be demarcated for purposes of discussion and clarity. Peripheral sole elements 172 may extend generally along the periphery of sole structure 103. Central sole elements 171 may be located within a central portion of sole structure 103. In some embodiments, central sole elements 171 may be surrounded by peripheral sole elements 172. That is, in some embodiments, central sole elements 171 may not extend to the peripheral edge of sole structure 103.

In some embodiments, peripheral sole elements 172 may have various shapes and sizes. In some embodiments, the shape of peripheral sole elements 172 may be influenced by the overall shape of the peripheral edge of sole structure 103. Additionally, peripheral sole elements 172 may be influenced by the angle and size of plurality of sipes 130. Referring particularly to peripheral sole element 174 located in heel region 14, the shape of peripheral sole element 174 is influenced by lateral sipe 201, lateral sipe 202, and medial sipe 301. Further, peripheral sole element 174 is influenced by the shape of the peripheral edge of sole structure 103. By changing the length or angle of any of the lateral sipes or medial sipes, the shape of peripheral sole element 174 may be influenced. Further, as shown, the shape of second outer sole member 161 may be influenced by the sipes that bound peripheral sole element 174. In some embodiments, the shape of second outer sole member 161 may correspond to the shape of peripheral sole element 174. Additionally, the length and shape of longitudinal sipe 401 influences the shape of peripheral sole element 174. As shown in FIGS. 2 and 3, longitudinal sipe 401 extends from forefoot region 10 to heel region 14; however, longitudinal sipe 401 does not extend to heel edge 126. The length of longitudinal sipe 401 is in contrast to longitudinal sipe 402 that extends to heel edge 126. It should be recognized that by extending sipes to the peripheral edges of sole structure 103 or not extending sipes to the peripheral edges of sole structure 103 the shape and size of peripheral sole elements 172 may be influenced.

In some embodiments, central sole elements 171 may have generally the same shape. In other embodiments, central sole elements 171 may have various shapes. As discussed previously, the length and direction or orientation of plurality of sipes 130 may influence the shape of central sole elements 171. As shown in FIGS. 2 and 3, central sole elements 171 have generally a triangular shape. The shape and orientation of central sole elements 171 is discussed in further detail later in this detailed description.

In some embodiments, sole elements 170 may have different shapes and sizes in different regions of sole structure 103. For example, sole element 173 located in forefoot region 10, may have a different shape than other sole elements of sole structure 103. As shown, multiple sipes extend into sole element 173; however, the sipes may terminate before reaching the peripheral edge of sole structure 103. For example, longitudinal sipe 401 terminates before reaching toe edge 124. Additionally, sole element 173 includes a larger distance without a lateral sipe or medial sipe than other areas along sole structure 103. For example, dimension 175 indicates the distance between lateral sipe 203 and lateral sipe 204. The distance between lateral sipe 203 and lateral sipe 204 may be approximately the same distance between other sipes within sole structure 103. As shown in FIGS. 2 and 3, however, lateral sipe 203 is the final sipe along lateral edge 154 in forefoot region 10. The lack of additional lateral sipes influences the size and shape of sole element 173.

In some embodiments, various-sized sole elements may impact the performance or feel of sole structure 103. For example, as discussed previously, sole element 173 in forefoot region 10 may be larger than other sole elements within sole structure 103. By utilizing a larger sole element, the flexibility and stability of sole structure 103 may be influenced. Sole element 173 may provide stability and rigidity within a portion of forefoot region 10. In some embodiments, the size and shape of sole element 173 may provide additional traction and stability to a wearer during use of article 100. Other areas of sole structure 103 may include smaller sole elements. By including smaller sole elements along an area of sole structure 103, greater flexibility may be achieved.

Figure 5:
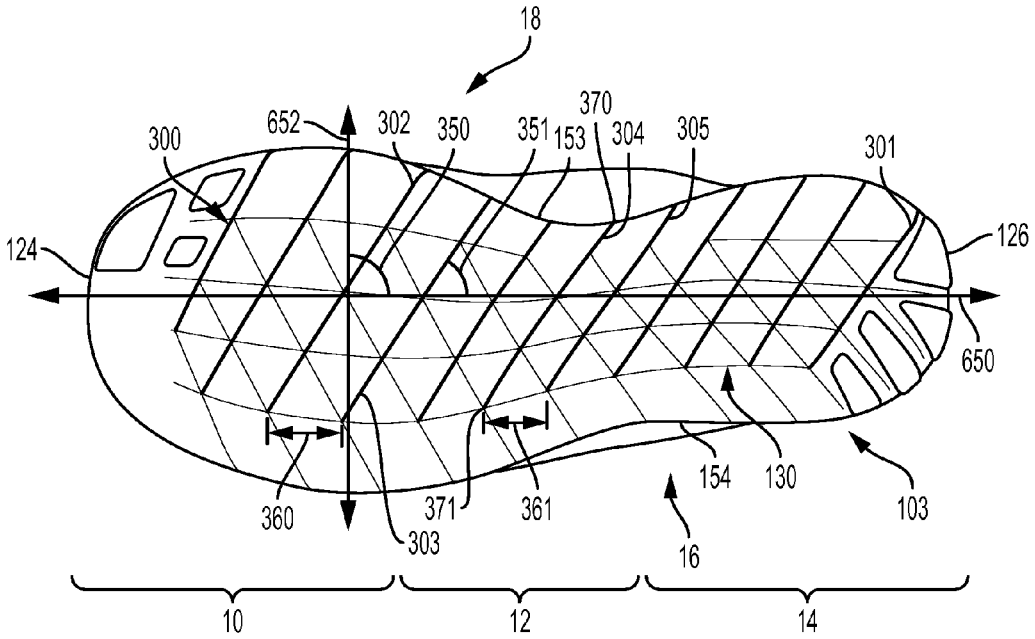
FIG. 5 is a bottom view of medial sipes along an embodiment of a sole structure.
Figure 6:
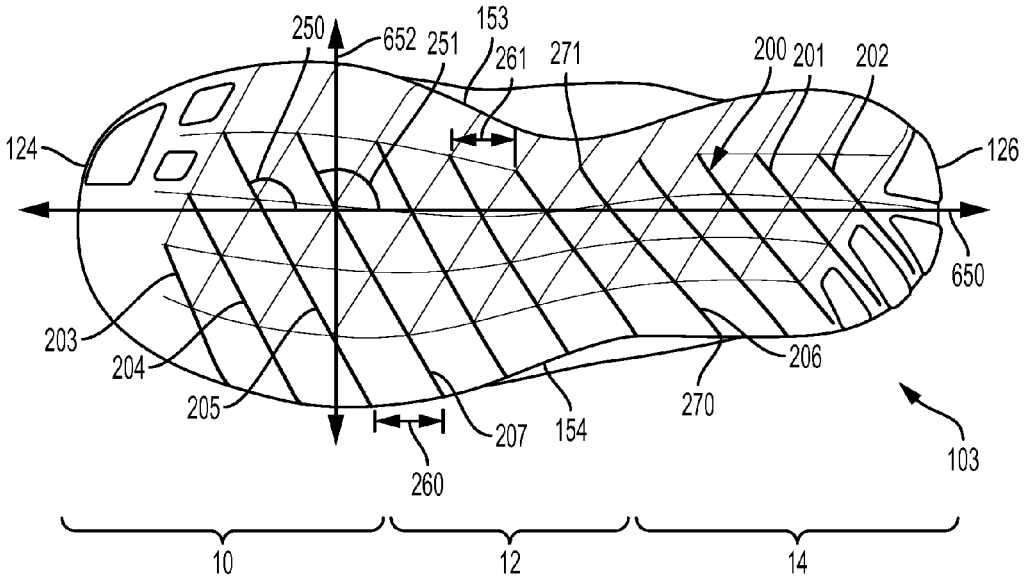
FIG. 6 is a bottom view of lateral sipes along an embodiment of a sole structure.
Figure 7:
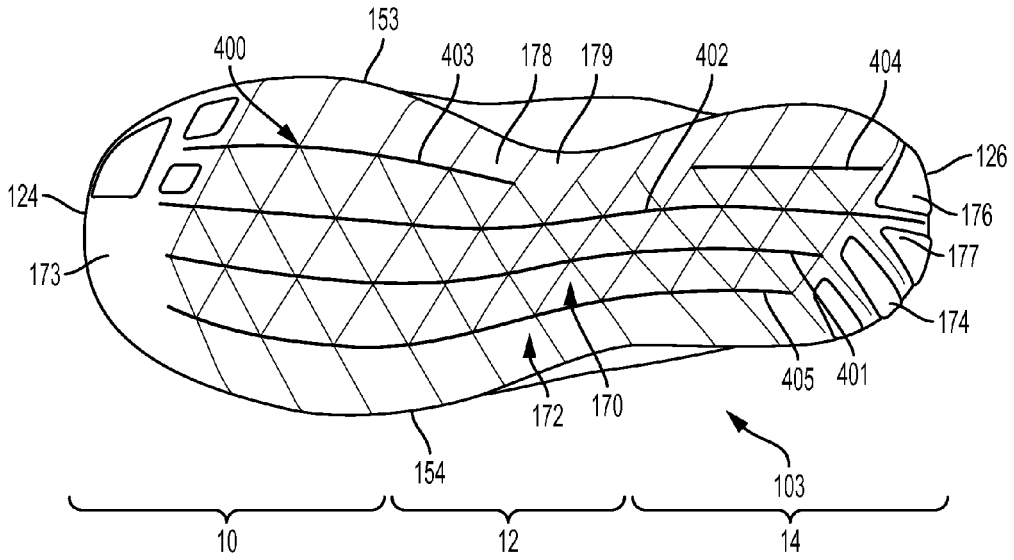
FIG. 7 is a bottom view of longitudinal sipes along an embodiment of a sole structure.

Referring now to FIGS. 5-7, plurality of sipes 130 are demarcated for ease of discussion and viewing. In FIG. 5, medial sipes 300 are featured. In FIG. 6, lateral sipes 200 are depicted. In FIG. 7, longitudinal sipes 400 are featured. Referring to medial sipes 300, medial sipes 300 extend from medial edge 153 toward lateral edge 154. In some embodiments, however, medial sipes 300 may not extend fully to lateral edge 154. For example, medial sipe 302 extends from medial edge 153 toward lateral edge 154. Before medial sipe 302 reaches lateral edge 154, however, medial sipe 302 terminates. In some embodiments, medial sipe 302 may terminate at an intersection with a lateral sipe. It should be recognized that a similar orientation of sipes is shown in FIG. 6 with respect to lateral sipes 200. For example, lateral sipe 205 extends from lateral edge 154 toward medial edge 153. Lateral sipe 205, however, does not fully extend to medial edge 153. Additionally, lateral sipe 205 may terminate at an intersection with a medial sipe.

Figure 8:
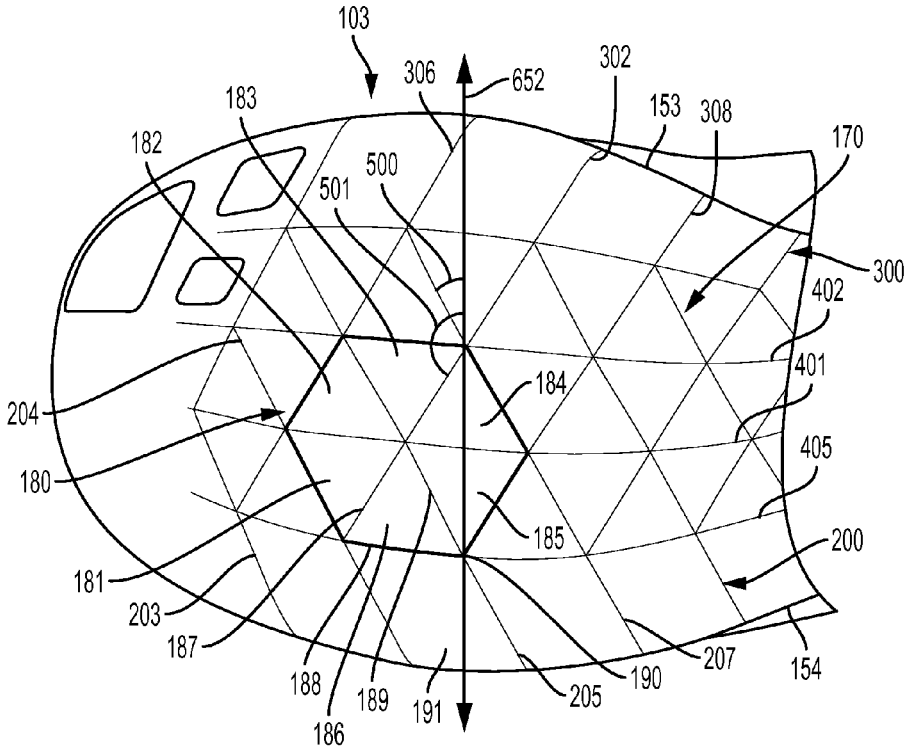
FIG. 8 is a bottom view the sole structure including sipes and sole elements.

In some embodiments, as shown in FIG. 5, medial sipes 300 may intersect with other sipes of plurality of sipes 130. In some embodiments, as shown in FIG. 8 and discussed in further detail below, medial sipe 302 may intersect sipes from lateral sipes 200 and longitudinal sipes 400.

In some embodiments, medial sipes 300 may generally extend along the same direction. For example, medial sipe 302 and medial sipe 303 extend along substantially the same direction. In some embodiments, medial sipe 302 and medial sipe 303 may be substantially parallel. Additionally, in some embodiments, medial sipe 302 and medial sipe 303 may be oriented along approximately the same angle with respect to longitudinal axis 650. For example, angle 350 may be substantially the same as angle 351. In other embodiments, angle 350 and angle 351 may be different angles. The same general concept may be applied to lateral sipes 200. For example, angle 250 may be substantially the same as angle 251. In some embodiments, angle 351 may be similarly oriented to longitudinal axis 650 as are angle 250 and angle 251. In some embodiments, angle 250 may be 180 degrees minus angle 351. For example, in some embodiments, angle 351 may be 30 degrees. Angle 251 may, therefore, be 180 degrees minus 30 degrees, or 150 degrees.

In some embodiments, the slope of sipes may be opposite or negative. As shown, medial sipe 302 may have a first slope in relation to longitudinal axis 650 and may be perpendicular to lateral axis 652. Lateral sipe 207 may have a second slope with respect to longitudinal axis 650 and may be perpendicular to lateral axis 652. In some embodiments, the second slope may be the negative of the first slope.

In some embodiments, medial sipes 300 may be evenly spaced. That is, in some embodiments, the distance between sipes may be approximately the same along the length of sole structure 103. For example, dimension 360 is the distance between medial sipe 302 and medial sipe 303. In some embodiments, all of the sipes of plurality of sipes 130 may be spaced approximately the same distance of dimension 360. In other embodiments, the spacing of sipes may be varied along the length of sole structure 103. For example, as shown in FIG. 5, dimension 361 is the distance between medial sipe 304 and medial sipe 305. In some embodiments, dimension 361 may be smaller or less than dimension 360. The same general concept may be applied to lateral sipes 200. For example, in some embodiments, dimension 261 may be smaller or less than dimension 260. In other embodiments, dimension 261 may be the same as dimension 260. In further embodiments, dimension 261 may be greater than dimension 260.

In some embodiments, the spacing of sipes may be varied along different areas of sole structure 103. In some embodiments, particular spacing may be provided to achieve a particular flexibility in certain areas. For example, in some embodiments, the spacing in midfoot region 12 may be different than the spacing of sipes in forefoot region 10. In some embodiments, smaller spacing may be used to allow for increased flexibility. By increasing the number of sipes in an area, sole structure 103 may be able to bend, twist, and flex to a greater degree than other areas of sole structure 103 than have fewer sipes.

It should also be recognized, that different sipes may be spaced differently. For example, lateral sipes 200 may have a different spacing layout than medial sipes 300. For example, in some embodiments, lateral sipes 200 may have a first approximate spacing in midfoot region 12. Medial sipes 300 may have a second approximate spacing in midfoot region 12. In some embodiments, the first approximate spacing may be different than the second approximate spacing. The spacing may be altered to achieve a desired twist or bend in a particular direction. In some cases, having different numbers of medial sipes 300 and lateral sipes 200 in a given region, such as midfoot region 12, of a sole structure may result in a different amount of twisting in a first circumferential direction and in an opposing second circumferential direction. This differential type of twisting is discussed in further detail below and shown in FIGS. 11-13.

In some embodiments, medial sipes 300 may be oriented along sole structure 103 in a particular direction or orientation. For example, first end 370 of medial sipe 304 may be located along medial edge 153. Second end 371 may be located along lateral side 16 of sole structure 103. As depicted, first end 370 may be located closer to heel edge 126 than is second end 371. Second end 371 may also be located closer to toe edge 124 than is first end 370. Additionally, other sipes of medial sipes 300 may be similarly oriented. That is, the ends of medial sipes 300 that are located at medial edge 153 are located closer to heel edge 126 of sole structure 103 than are the ends of medial sipes 300 that are located toward lateral edge 154 of sole structure 103. In some embodiments, a majority of the sipes of medial sipes 300 is oriented in the manner described. In the embodiment shown in FIG. 5, all of the sipes of medial sipes 300 are oriented in the manner described. The same general concept may be applied to lateral sipes 200 as with medial sipes 300. For example, first end 270 of lateral sipe 206 may be located along lateral edge 154 of sole structure 103. Second end 271 of lateral sipe 206 may be located toward medial edge 153 of sole structure 103. First end 270 may be located closer to heel edge 126 than is second end 271. Additionally, second end 271 may be located closer to toe edge 124 than is first end 270.

In some embodiments, medial sipes 300 may be oriented approximately in a straight line. That is, in some embodiments, medial sipes 300 may have an approximately constant slope. In other embodiments, medial sipes 300 may have various changing slopes. In some embodiments, the same concept may apply to lateral sipes 200. That is, lateral sipes 200 may have an approximately constant slope along the length of sole structure 103.

Referring now to FIG. 7, longitudinal sipes 400 are featured. As shown, longitudinal sipes 400 extend longitudinally along sole structure 103. In some embodiments, longitudinal sipes 400 may extend from heel region 14 to forefoot region 10. In some embodiments, longitudinal sipes 400 may extend to heel edge 126. In other embodiments, longitudinal sipes 400 may stop short of heel edge 126. For example, longitudinal sipe 401 does not extend to heel edge 126. In contrast, longitudinal sipe 401 extends to heel edge 126. By changing the length of longitudinal sipes 400, the shape and size of plurality of sole elements 170 may be affected as discussed previously. Further, the bending and flexing nature of sole structure 103 may be limited by not extending a sipe to heel edge 126 or toe edge 124. In some cases, the amount of flex may be limited in order to allow for increased stability. For example, longitudinal sipe 402 may extend between peripheral sole element 176 and peripheral sole element 177. This configuration of longitudinal sipe 402 may allow for peripheral sole element 176 and peripheral sole element 177 to bend and twist relative to longitudinal sipe 402 along heel edge 126. In contrast, peripheral sole element 177 and peripheral sole element 174 may not bend or twist along a longitudinal sipe between peripheral sole element 177 and peripheral sole element 174. The amount or degree to which sole structure 103 bends in different areas may be, therefore, altered or influenced by varying the location of longitudinal sipes 400 along sole structure 103.

In some embodiments, longitudinal sipes 400 may extend along approximately the same direction. That is, in some embodiments, each sipe of longitudinal sipes 400 may be approximately parallel to one another. In other embodiments, longitudinal sipes 400 may extend along sole structure 103 at different orientations with respect to one another.

In some embodiments, the spacing between longitudinal sipes 400 may vary. In some embodiments, the spacing between longitudinal sipes 400 may change depending on the location of longitudinal sipes 400 within sole structure 103. For example, in some embodiments, the spacing between longitudinal sipes 400 in heel region 14 may be less than the spacing between longitudinal sipes 400 in forefoot region 10. In some embodiments, the spacing may be varied in order to keep the same number of longitudinal sipes in forefoot region 10 and in heel region 14. For example, the distance from medial edge 153 to lateral edge 154 of sole structure 103 in heel region 14 may be less than the distance from medial edge 153 to lateral edge 154 of sole structure 103 in forefoot region 10. In order to keep the same number of longitudinal sipes 400 in forefoot region 10 and in heel region 14, the spacing between longitudinal sipes 400 is altered. By maintaining the same number of sipes in heel region 14 and forefoot region 10, the lateral control of article 100 may remain constant or even throughout the length of sole structure 103 and may improve control and feel for a user.

In some embodiments, longitudinal sipes 400 may be located in different regions of sole structure 103. That is, in some embodiments, a different number of longitudinal sipes 400 may be located in one region as compared to another. As shown in FIG. 7, longitudinal sipe 403 extends from sole element 173 toward heel region 14. As shown, however, longitudinal sipe 403 terminates in midfoot region 12. In some embodiments, longitudinal sipe 403 may terminate within forefoot region 10. Additionally, longitudinal sipe 404 may extend from peripheral sole element 176 toward forefoot region 10. As shown, however, longitudinal sipe 404 terminates before reaching forefoot region 10. In some embodiments, longitudinal sipe 404 may terminate within midfoot region 12. In still further embodiments, longitudinal sipe 404 may terminate within heel region 14. As shown, a space between longitudinal sipe 403 and longitudinal sipe 404 is formed that does not include a longitudinal sipe along the same approximate line or direction that longitudinal sipe 403 and longitudinal sipe 404 are located. That is, in some embodiments, an area along sole structure 103 may include fewer longitudinal sipes than other areas. As shown, sole structure 103 includes four longitudinal sipes in forefoot region 10 and four longitudinal sipes in heel region 14. In at least a portion of midfoot region 12, however, sole structure 103 includes three longitudinal sipes. By varying the number of longitudinal sipes 400 in different areas of sole structure 103, the flexibility of sole structure 103 may vary. For example, the area between longitudinal sipe 403 and longitudinal sipe 404 may have less lateral flexibility than other areas of sole structure 103. This configuration may assist in providing resistance to twisting during a cutting motion during the use of article 100.

In some embodiments, longitudinal sipes 400 may influence the shape of peripheral sole elements 172. For example, peripheral sole element 178 is formed or defined by longitudinal sipe 403 along with medial sipes and medial edge 153. In contrast, peripheral sole element 179 is defined by medial sipes and lateral sipes and medial edge 153. Peripheral sole element 179, by not having a side defined by a longitudinal sipe, has a different shape than many other peripheral sole elements 172. The shape of peripheral sole element 179 along with other similarly shaped peripheral sole elements 172, may provide different resistant to stretch or twist than other peripheral sole elements 172. For example, the shape of peripheral sole element 179 may allow for peripheral sole element 179 to twist to a greater degree in conjunction with other sole elements 170 than differently shaped peripheral sole elements 172. The resistance to twist, or the lack of resistance to twist, may be influenced by the shape of peripheral sole elements 172. In one embodiment, by altering the length or shape of one of longitudinal sipes 400, the shape of peripheral sole elements 172 may be influenced.

Referring to FIG. 8, the particular layout of sole elements 170 is depicted. A particular section of sole elements 170 is highlighted as sole subsection 180. Sole subsection 180 includes central sole element 181, central sole element 182, central sole element 183, central sole element 184, central sole element 185, and central sole element 186. As shown, sole subsection 180 is in the shape of a hexagon. Sole subsections may be referred to later in this detailed description. In should be recognized that varying the shape, length, and orientation of plurality of sipes 130 may affect the shape of sole subsection 180 and the sole elements of sole subsection 180. As depicted, lateral sipe 204, lateral sipe 205, and lateral sipe 207 extend through or form a side of sole subsection 180. Additionally, medial sipe 306, medial sipe 302, and medial sipe 308 extend through, or form a side of sole subsection 180. Further, longitudinal sipe 405, longitudinal sipe 401, and longitudinal sipe 402 extend through, or form a side of sole subsection 180.

Referring particularly to central sole element 186, central sole element 186 is formed or bordered by medial sipe 302, lateral sipe 205, and longitudinal sipe 405. Central sole element 186, therefore, has edge 187, edge 188, and edge 189 that are formed by the sipes that extend through sole structure 103. By varying the location of the sipes, the edges of central sole element 186 may be varied and therefore the shape of central sole element 186 may be varied.

As shown, each of the sole elements within sole subsection 180 may be formed by a medial sipe, lateral sipe, and longitudinal sipe. As shown, at least one longitudinal sipe, one medial sipe, and one lateral sipe intersect with one another at each point of the central sole elements of sole subsection 180. As shown, therefore, each of the sole elements within the sole subsection may be triangular in shape. Further, other sole elements of central sole elements 171 may have a similar shape.

As shown throughout sole structure 103, plurality of sipes 130 have a particular layout. In reference to FIG. 8, lateral sipes 200 may extend at an approximate first angle 500 with respect to lateral axis 652 or axes parallel to lateral axis 652. Medial sipes 300 may extend at an opposite second angle 501. That is, in some embodiments, medial sipes 300 may extend at an angle that is 180 degrees minus value of first angle 500. For example, in some embodiments, the first angle 500 is 30 degrees. In such embodiments, second angle 501 may be 180 degrees minus 30 degree, or 150 degrees. In other embodiments, medial sipes 300 and lateral sipes 200 may be oriented at different angles.

In some embodiments, lateral sipes 200 and medial sipes 300 may intersect. In still further embodiments, longitudinal sipes 400 may also intersect both lateral sipes 200 and medial sipes 300. That is, in some embodiments, lateral sipes 200, medial sipes 300, and longitudinal sipes 400 may all intersect at the same location. In some embodiments, the plurality of sipes 130 may intersect in the same manner through sole structure 103. That is, in some embodiments, at every area that longitudinal sipes 400 intersect with medial sipes 300, longitudinal sipes 400 also intersect with lateral sipes 200. In some embodiments, some areas of sole structure 103 may be different. For example, a longitudinal sipe does not intersect with the lateral sipe and medial sipe at second end 271 as shown in FIG. 6.

In some embodiments, the configuration of sipes at intersections can vary in different locations along sole structure 103. In some embodiments, the configuration of sipes at intersections can vary along the edges of peripheral sole elements 172. For example, referring to intersection 190, intersection 190 is formed by longitudinal sipe 405, medial sipe 308, and lateral sipe 205. In this sense, intersection 190 is similar to other intersections within sole structure 103. Medial sipe 308, however, does not continue through peripheral sole element 191. This configuration of medial sipe 308 contributes to the different shape that peripheral sole element 191 has compared to central sole element 186.

In some embodiments, as lateral sipes 200 extend from lateral edge 154, lateral sipes 200 may intersect medial sipes 300. In some embodiments, medial sipes 300 may terminate at this location. That is, in some embodiments, the first intersection between lateral sipes 200 and medial sipes 300 as lateral sipes 200 extend from lateral edge 154 may be the end or termination point of medial sipes 300. Additionally, the first intersection between medial sipes 300 and lateral sipes 200 as medial sipes 300 extend from medial edge 153 may be the end or termination point of lateral sipes 200. For example, as shown in FIG. 8, lateral sipe 205 extends from lateral edge 154 toward medial edge 153. Lateral sipe 205 encounters medial sipe 308 at intersection 190. This intersection is the first intersection lateral sipe 205 has with a medial sipe. At this intersection, medial sipe 308 is terminated. The termination of medial sipes 300 away from lateral edge 154 as well as the termination of lateral sipes 200 away from medial edge 153 may affect the twisting and bending nature of sole structure 103.

In some embodiments, plurality of sipes 130 may intersect with a predetermined number of sipes before terminating. For example, lateral sipes 200 may intersect with a predetermined number of medial sipes 300 before terminating. As shown in FIG. 8, for example, medial sipe 306 intersects four lateral sipes before terminating. As shown, medial sipe 306 intersects with lateral sipe 207, lateral sipe 205, lateral sipe 204, and terminates at the intersection of medial sipe 306 and lateral sipe 203. In some embodiments, the same pattern or configuration may be present throughout the length of sole structure 103. That is, in some embodiments, each of the sipes of lateral sipes 200 and medial sipes 300 may intersect with four of the opposite sipe. That is, lateral sipes 200 may intersect with four sipes of medial sipes 300 and medial sipes 300 may intersect with four sipes of lateral sipes 200. In other embodiments, the number of intersections may be larger or smaller. In still further embodiments, the number of intersections may vary along the length of sole structure 103.

Figure 9:
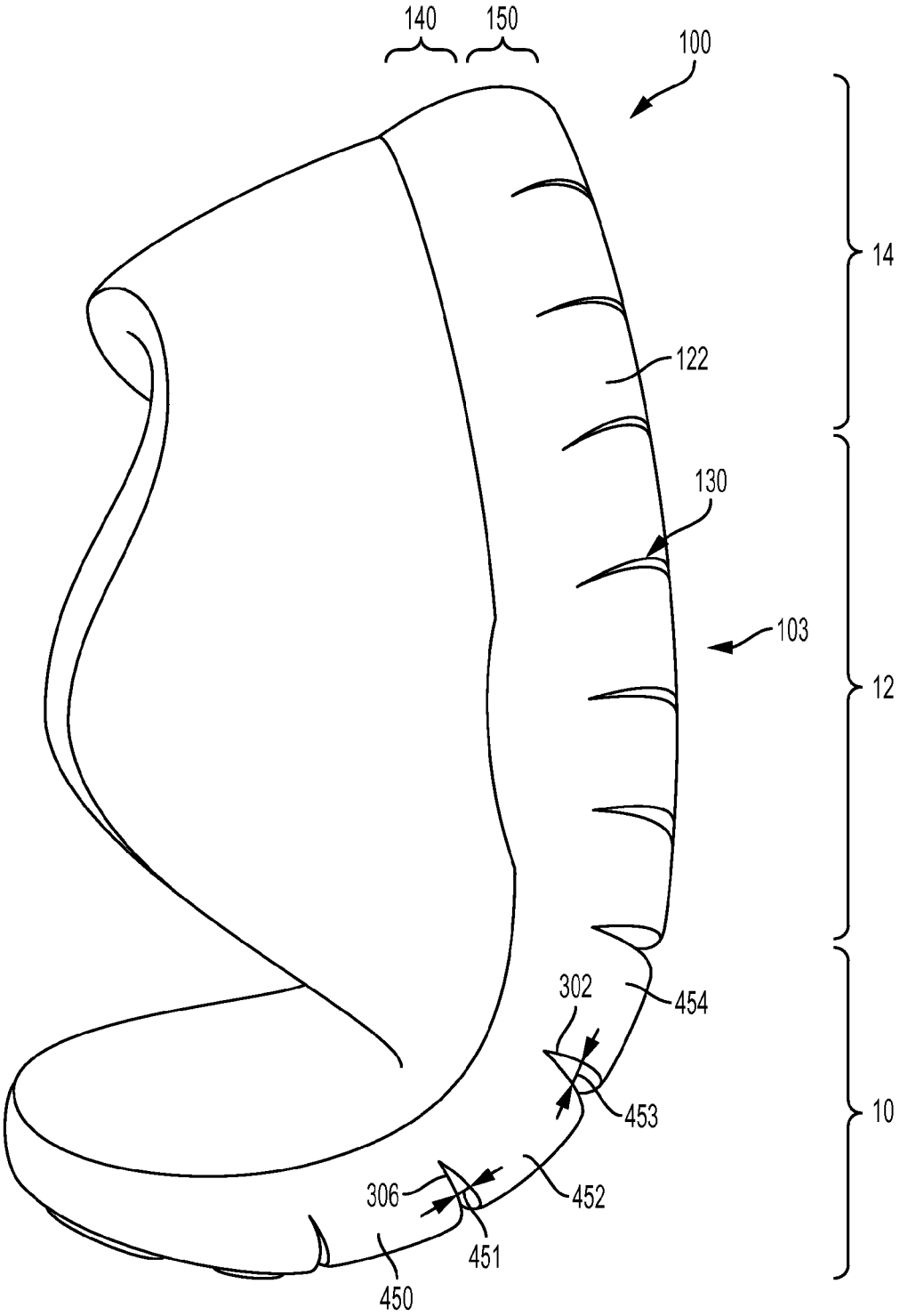
FIG. 9 is a lateral view of an embodiment of a sole structure in a flexed position.

Referring to FIG. 9, sole structure 103 is shown flexing or bending when subjected to a force or during normal use of article 100. As depicted, article 100 may be able to bend such that a portion of forefoot region 10 contacts a largely horizontal surface while at the same time a portion of heel region 14 may be located largely along a vertical axis. That is, in some embodiments, portions of sole structure 103 may be oriented along axes that are perpendicular to one another.

In some embodiments, plurality of sipes 130 may assist in allowing sole structure 103 to bend in the manner depicted in FIG. 9. As shown, medial sipe 302 and medial sipe 306 may expand and separate such that the peripheral elements adjacent to medial sipe 302 and medial sipe 306 extend away from one another. As discussed previously, in addition to the thickness of connecting portion 140 the depth of plurality of sipes 130 may influence the degree to which sole structure 103 may bend and flex. Additionally, the location of plurality of sipes 130 may influence the degree to which sole structure 103 may bend and flex. By placing sipes in various areas that correspond to flex points of a foot, sole structure 103 may react to the bending motions of a foot and be able to flex during use. In other embodiments, sipes may not be placed in areas that correspond to flex points of a foot. In such embodiments, the flex of sole structure 103 and article 100 may be limited. In some embodiments, the specific location of sipes may be used to prevent overextension of parts of a foot or to allow free motion of a foot during use.

As shown in FIG. 9, different areas of sole structure 103 may bend or flex to different degrees. As shown, medial sipe 306 expands such that peripheral sole element 450 is distance 451 away from peripheral sole element 452. Additionally, medial sipe 302 bends or expands such that peripheral sole element 452 is distance 453 away from peripheral sole element 454. In some embodiments, distance 453 may be greater than distance 451. In addition, sipes that are located in heel region 14 may not open or expand to the same degree as the sipes in forefoot region 10 and midfoot region 12. As shown, therefore, sipes may expand and contract independently from one another.

Figure 10:
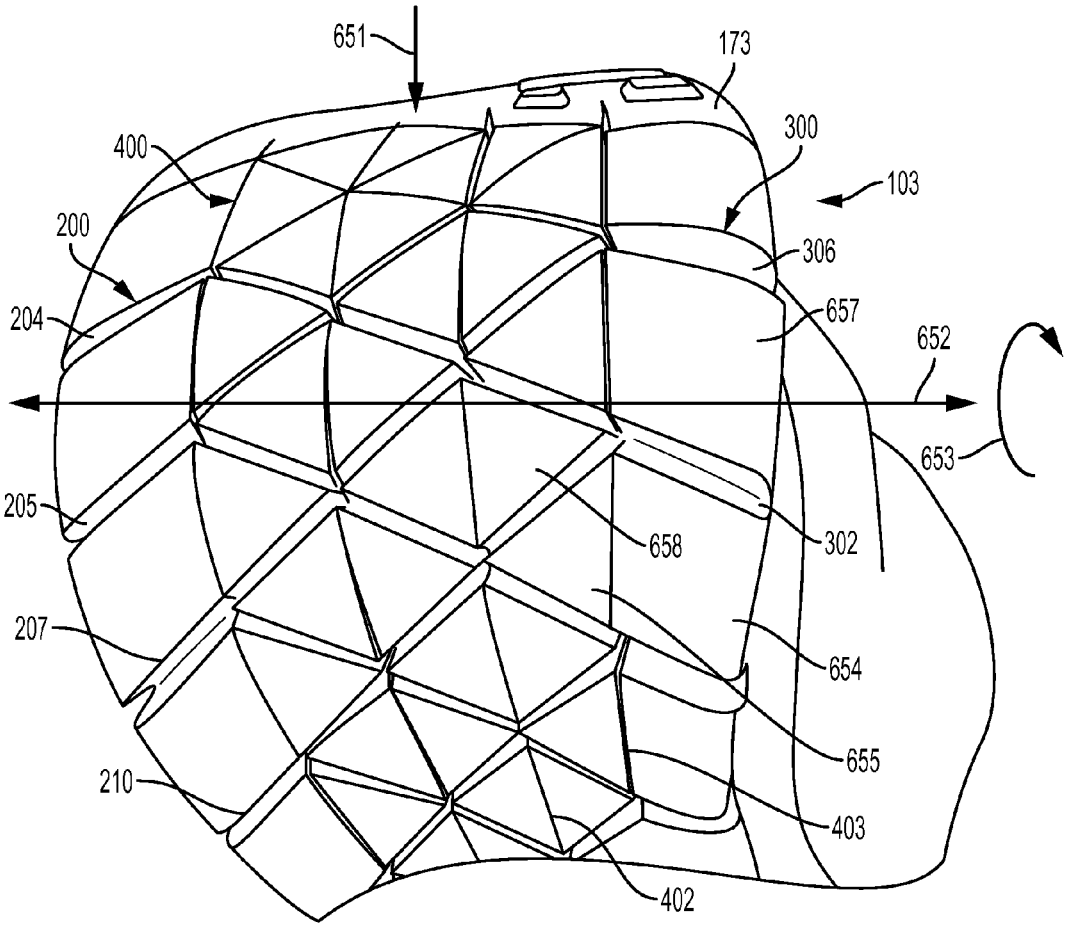
FIG. 10 is a front view of an embodiment of a sole structure in a flexed position.

Referring to FIG. 10, sole structure 103 is depicted with force 651 normal to sole element 173. As shown, sole structure 103 bends or rotates about lateral axis 652 or an axis parallel to lateral axis 652 in the direction 653. In some embodiments, the layout or configuration of plurality of sipes 130 may influence the manner in which sole elements 170 interact when a portion of sole structure 103 is subjected to a force.

In some embodiments, as sole structure 103 is bent longitudinal sipes 400 may contract or compress. For example, the space formed by longitudinal sipe 403 is minimized between peripheral sole element 654 and central sole element 655. As shown in FIG. 10, the width of longitudinal sipes 400 may be minimized along the length of sole structure 103, thereby allowing sole elements that are adjacent to one another along longitudinal sipes 400 to contact and press against one another.

In contrast, medial sipes 300 and lateral sipes 200 may expand such that sole elements that are adjacent to one another about medial sipes 300 and lateral sipes 200 extend away from one another. For example, medial sipe 302 expands such that peripheral sole element 654 is spaced from peripheral sole element 657 along medial sipe 302. Additionally, lateral sipe 210 expands such that central sole element 658 is spaced from central sole element 655. As such, sole structure 103 expands or extends along the longitudinal direction through the expansion of both medial sipes 300 and lateral sipes 200.

Figure 11:
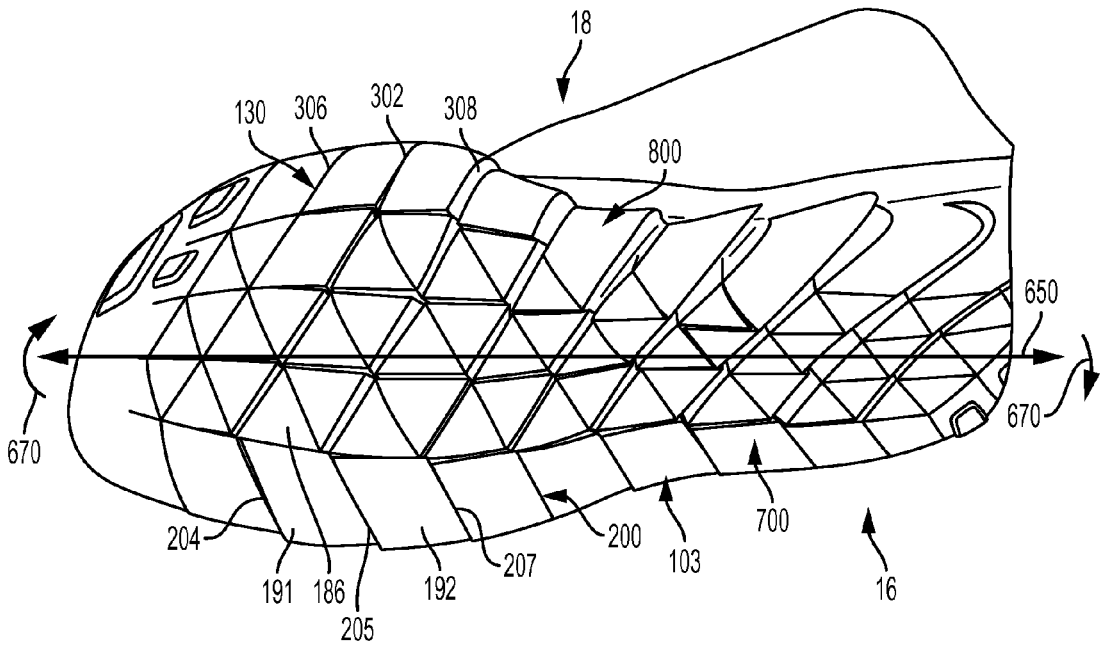
FIG. 11 is a view of an embodiment of a sole structure being twisted.
Figure 12:
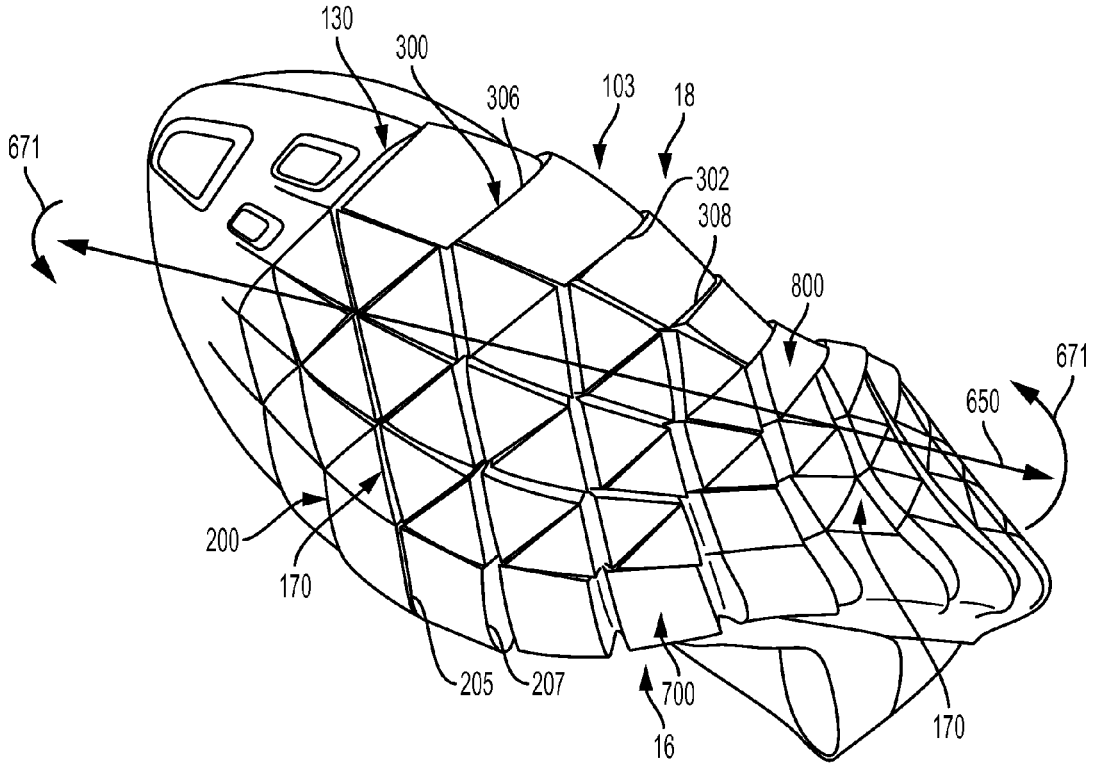
FIG. 12 is a view of an embodiment of a sole structure being twisted.

Referring to FIGS. 11 and 12, sole structure 103 is depicted as being twisted or rotated in various directions. In some embodiments, the location, orientation, and layout of plurality of sipes 130 may contribute to sole structure 103 providing selective torsional rigidity. As shown in FIG. 11, forefoot region 10 of sole structure 103 is subjected to torsional forces 670 about longitudinal axis 650. As shown, lateral sipes 200 compress such that sole elements that are located adjacent to lateral sipes 200 compress against one another. For example, peripheral sole element 191 compresses against peripheral sole element 192. Additionally, lateral peripheral sole elements 700 may press or compress against one another along the length of sole structure 103.

As shown in FIG. 11, medial sipes 300 may expand and spread apart such that medial peripheral sole elements 800 may be spaced apart from one another. As shown, therefore, lateral peripheral sole elements 700 may be compressed against one another while medial peripheral sole elements 800 expand away from one another. Torsional forces similar to torsional forces 670 may occur during use as a user cuts or moves laterally toward medial side 18. During such a movement, sole elements 170 may separate or split along medial sipes 300. The separation of sole elements 170 may splay or separate sole elements 170 such that the surface area of the ground or surface encompassed by sole structure 103 may increase as compared to sole structure 103 in an untensioned state. This increase in area may allow for a user to have a larger surface to gain balance or grip while cutting.

In some embodiments, lateral side 16 may be restricted from expanding or splaying to the same extent as sole elements 170 along medial side 18. Referring to lateral peripheral sole elements 700, lateral peripheral sole elements 700 may be compressed against one another. During a cutting motion as described above, lateral side 16 may be secured or restricted from splaying or separating. In some embodiments, the orientation of lateral peripheral sole elements 700 may additionally restrict the twisting motion along lateral side 16. The restriction of movement along lateral side 16 may provide a stable edge or area of sole structure 103 during a cutting motion. For example, during a cutting motion as described above, a foot may press against lateral side 16 of article 100. Because lateral peripheral sole elements 700 are compressed, the foot of a user may be controlled along lateral side 16.

As shown in FIG. 12, forefoot region 10 is subjected to torsional forces 671. As shown, torsional forces 671 are applied about longitudinal axis 650. Moreover, torsional forces 671 are applied about longitudinal axis 650 in the opposite direction as torsional forces 670. Torsional forces 671 may occur during use as a user moves or cuts laterally toward lateral side 16. In some embodiments, plurality of sipes 130 may be oriented such that lateral sipes 200 may expand or extend while medial sipes 300 contract. For example, lateral sipe 207 expands such that sole elements 170 located along lateral sipe 207 extend away from one another. As shown, lateral peripheral sole elements 700 extend away from one another. In contrast, medial peripheral sole elements 800 may compress or extend toward one another. This is opposite the motion of sole elements 170 as described when sole structure 103 is subjected to torsional forces 670. In the configuration as shown in FIG. 12, medial peripheral sole elements 800 may provide a secure or stable edge for a user during cutting. Further, sole elements 170 along lateral sipes 200 may splay or extend away from one another thereby increasing the surface area that sole structure 103 encompasses and providing a user with increased grip and control during a cutting motion.

Figure 13:
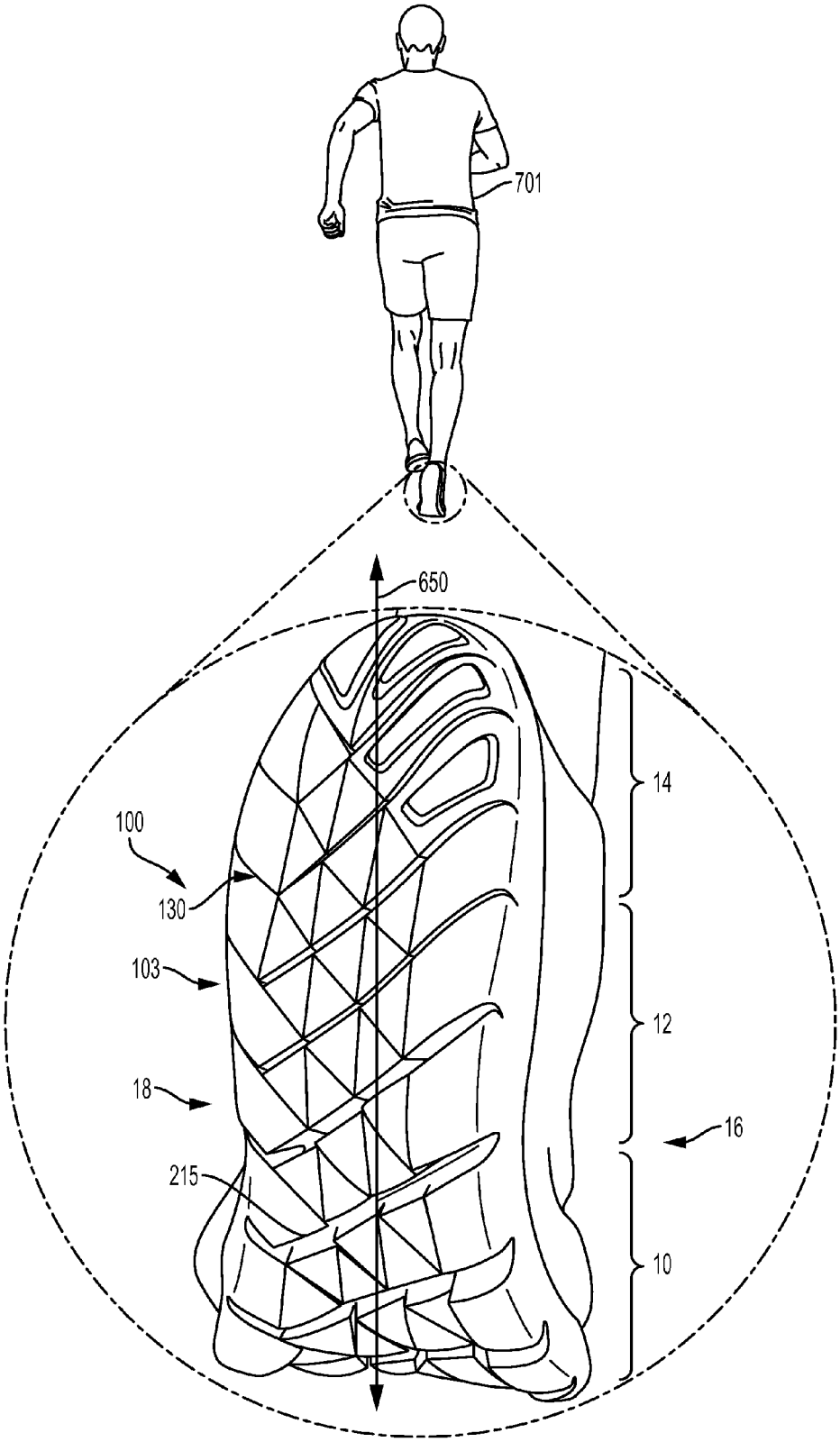
FIG. 13 is a view of an embodiment of an article during use by a wearer.

Referring to FIG. 13, article 100 is shown during use by user 701. In some embodiments, the angle and use of sipes through sole structure 103 may allow for sole structure 103 to bend and twist about plurality of sipes 130. As shown, for example, lateral sipe 215 expands or extends during the cutting motion by user 701. Because lateral sipe 215 is angled, user 701 may have less resistance to the cutting motion by sole structure 103 than in embodiments that include an alternate configuration of sipes. As shown, lateral sipe 215 corresponds or aligns with the cutting motion of user 701. For example, in embodiments that include sipes that extend along a lateral axis, user 701 may experience increased resistance from sole structure 103. The resistance may occur because a sipe extending along a lateral axis may not align with the cutting direction of user 701. By aligning plurality of sipes 130 with cutting directions, a decrease in resistance and an increase in flexibility may occur during cutting motions by users.

Additionally, as shown in FIG. 13, in some embodiments, portions of sole structure 103 may be able to be oriented in different directions. As shown in FIG. 13, user 701 cuts toward lateral side 16 while moving forward. Forefoot region 10 of sole structure 103 may remain in contact with a ground surface while midfoot region 12 and heel region 14 of sole structure 103 are not engaged with a ground surface. Additionally, heel region 14 may be rotated about longitudinal axis 650 with respect to forefoot region 10. The configuration of plurality of sipes 130 throughout sole structure 103 from forefoot region 10 to midfoot region 12 and to heel region 14 may assist in providing the flexibility desired.

In some embodiments, the number and orientation of sipes in midfoot region 12 may be varied. The number and orientation of sipes in midfoot region 12 may be adjusted to accommodate for the type of use that article 100 may experience. By varying the number and orientation of sipes in midfoot region 12 the flexibility of sole structure 103 may be influenced. In some embodiments, midfoot region 12 may include fewer sipes and may provide more rigidity during use. In other embodiments, midfoot region 12 may include more sipes that may provide additional flexibility to sole structure 103. In still further embodiments, midfoot region 12 may not include sipes and may further provide rigidity to sole structure 103.

Figure 14:
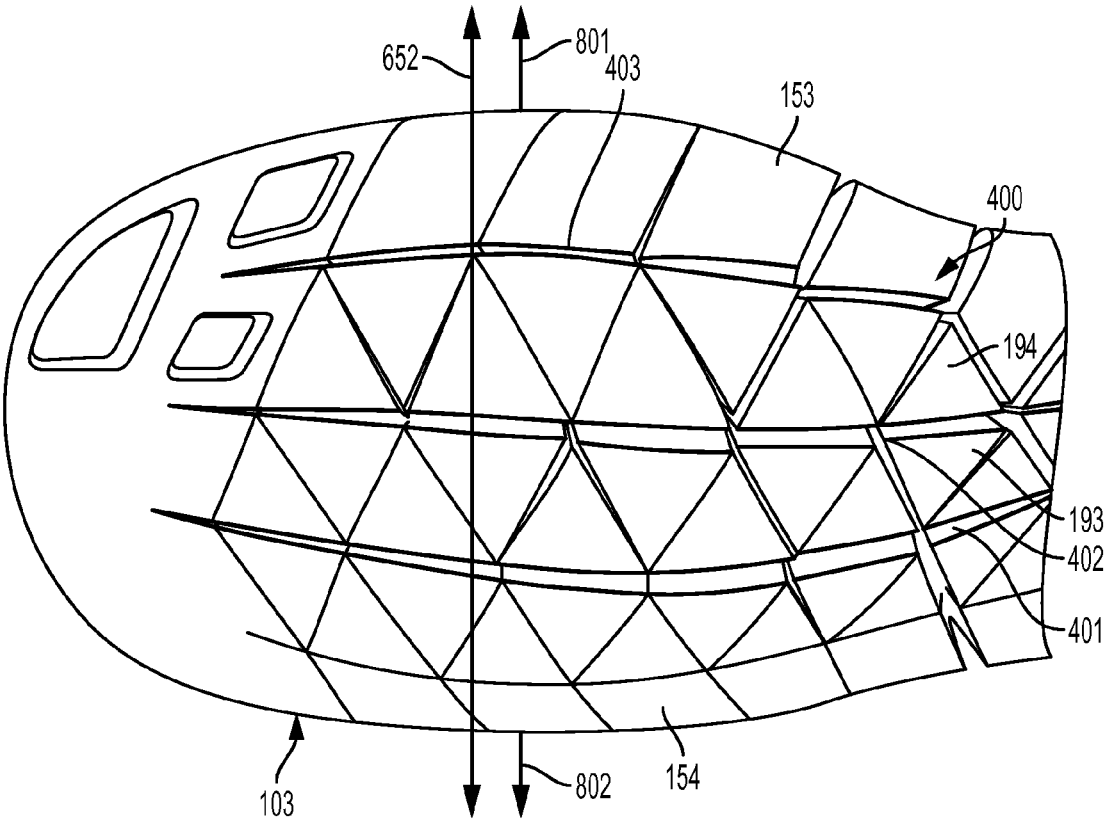
FIG. 14 is a view of an embodiment of an article being subjected to a lateral tensile force.

In some embodiments, sole structure 103 may be configured to provide stretch or flexibility along a lateral direction. As shown in FIG. 14, sole structure 103 is subjected to forces along a direction parallel to lateral axis 652. Tensile force 801 extends from medial edge 153 and tensile force 802 extends from lateral edge 154. In response to tensile force 801 and tensile force 802, longitudinal sipes 400 may separate or expand. For example, longitudinal sipe 402 expands such that central sole element 193 extends away from central sole element 194. Additionally, other sole elements along longitudinal sipes 400 may extend away from one another when sole structure 103 is subjected to a tensile force parallel to lateral axis 652.

In some embodiments, longitudinal sipes 400 may provide flexibility that improves feel and control to a user. In some embodiments, when stepping on uneven surfaces, sole structure 103 may expand along longitudinal sipes 400 to account for uneven surfaces. Additionally, longitudinal sipes 400 may expand during lateral movements by a user and increase the surface area of sole structure 103, increasing control and grip to a user.

Figure 15:
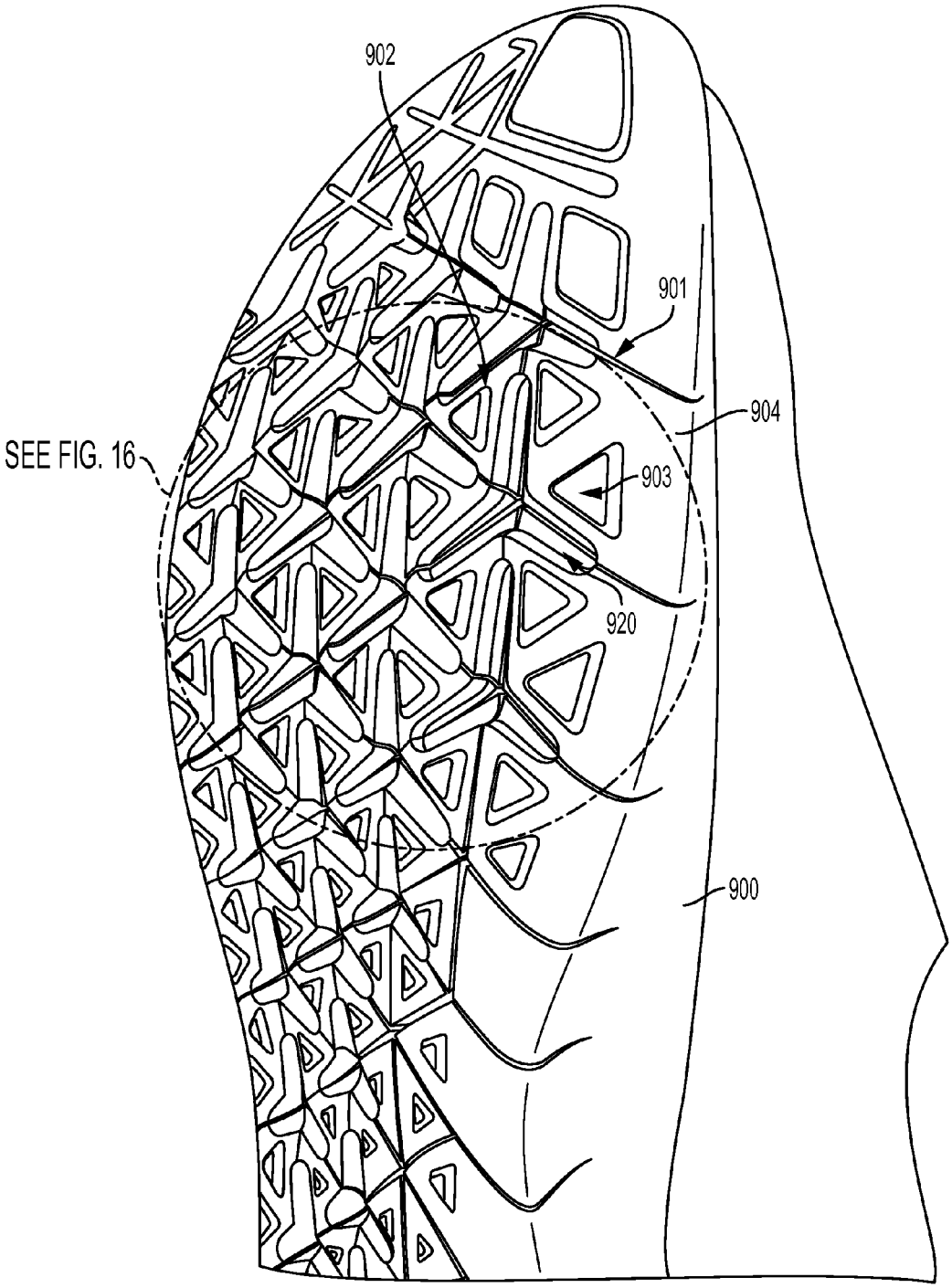
FIGS. 15-17 are views of an embodiment of an article of footwear incorporating recessed portions and raised portions.
Figure 16:
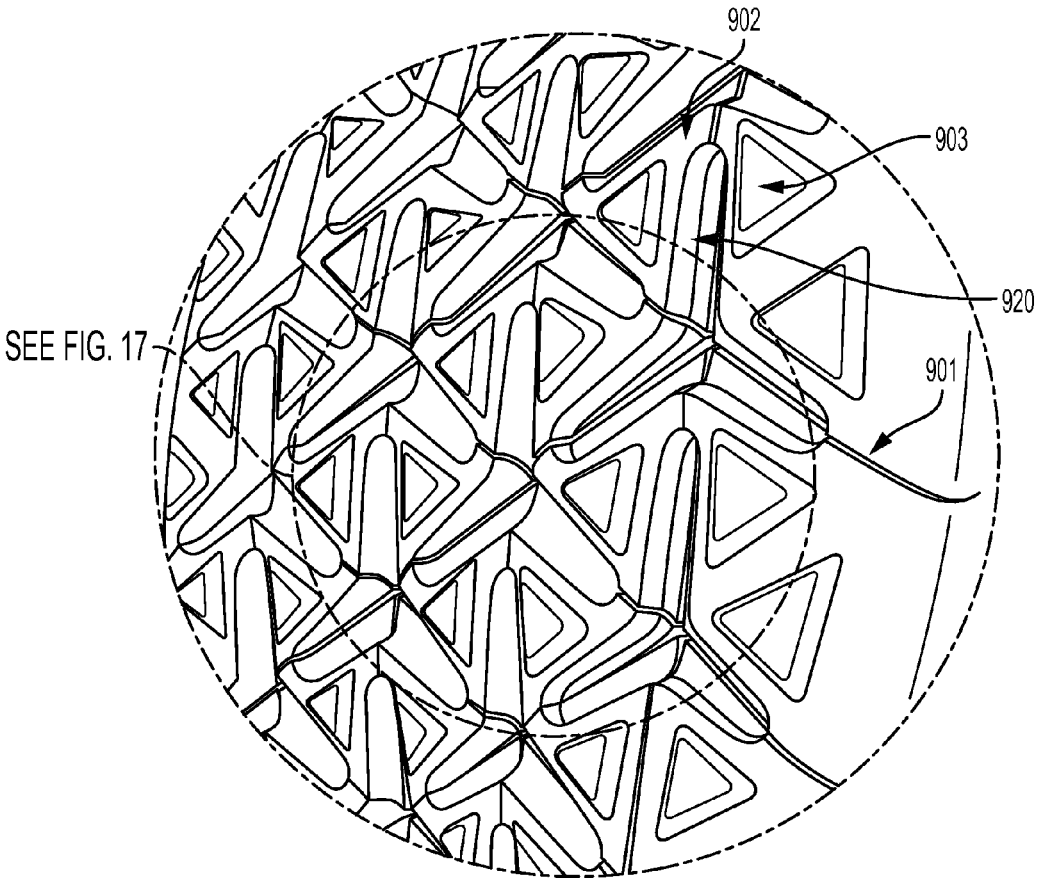
Figure 17:
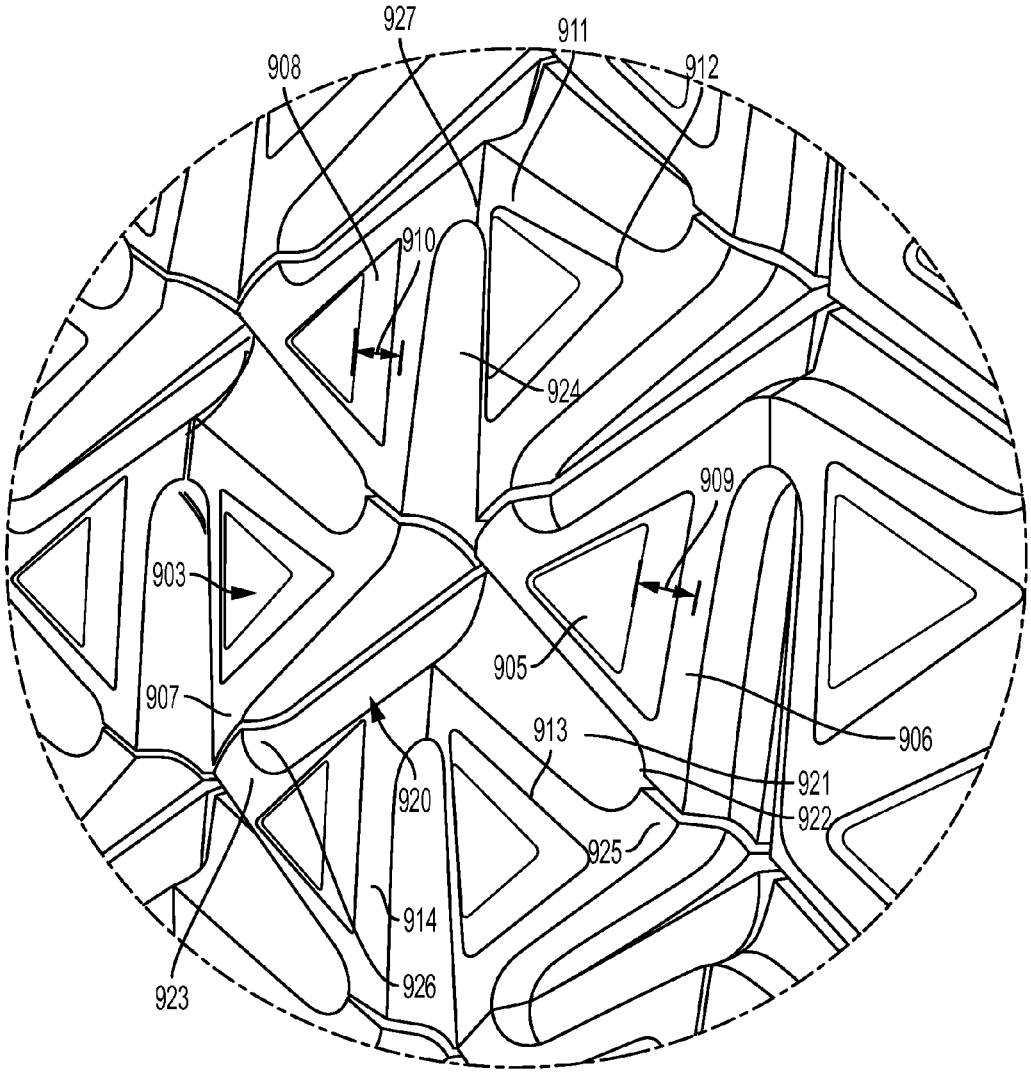

In some embodiments, a sole structure may include provisions for increasing traction. As shown in FIGS. 15-17, sole structure 900 includes plurality of sipes 901 in a similar orientation as plurality of sipes 130 of sole structure 103. Additionally, sole structure 900 includes sole elements 902 in a similar configuration as sole elements 170 of sole structure 103. In some embodiments, however, sole elements 902 may include raised portions 903. As shown in FIGS. 15-17, portion 904 of sole structure 900 is shown with raised portions 903. Although only shown as a portion of sole structure 900, it should be recognized that raised portions 903 may extend along sole structure 900. In some embodiments, each element of sole elements 902 may include a raised portion. In other embodiments, some sole elements of sole elements 902 may not include a raised portion. In other embodiments, sole elements 902 may not include raised portions 903.

In some embodiments, raised portions 903 may provide additional traction to sole structure 900. In other embodiments, raised portions 903 may provide additional cushioning to sole structure 900 during use of sole structure 900. In still additional embodiments, raised portions 903 may assist in preventing dirt or debris from accumulating along the surface of sole structure 900.

In some embodiments, raised portions 903 may have various shapes and sizes. In some embodiments, the shape of a raised portion may mimic the shape of the sole element on which the raised portion is formed. Referring to FIG. 17, raised portion 905 of central sole element 906 may have a triangular shape. As shown, raised portion 905 mimics or is shaped in a similar manner as central sole element 906. In other embodiments, the shape of raised portions may be varied between various sole elements.

In some embodiments, the size of raised portions 903 may vary between sole elements 902. In some embodiments, a raised portion may encompass a small percentage of the outer surface of a sole element. In other embodiments, a raised portion may encompass a larger percentage of the outer surface of a sole element. For example, raised portion 905 encompasses a smaller percentage of the outer surface of central sole element 906 compared to the percentage of the outer surface of central sole element 907 encompassed by raised portion 908. By varying the size of raised portions throughout sole structure 900, particular traction patterns may be formed in different areas of sole structure 900.

In some embodiments, raised portions may have varying heights or depths. Referring to raised portion 905, raised portion 905 has first height 909. Raised portion 908 has second height 910. In some embodiments, first height 909 may be different than second height 910. In some embodiments, first height 909 may be smaller than second height 910. The height of raised portions 903 may be varied to allow different areas of sole structure 900 to have different areas of traction or cushioning.

In some embodiments, sole structure 900 may include recessed portions. In some embodiments, recessed portions 920 may assist in preventing dirt and debris accumulation along an outer surface of sole structure 900. In some embodiments, recessed portions 920 (see FIG. 15) may be formed within multiple sole elements. In some embodiments, a portion of a single recessed portion may extend into six sole elements. In other embodiments, a portion of a single recessed portion may extend into a greater number of sole elements or a smaller number of sole elements. Referring particularly to recessed portion 921, recessed portion 921 extends into a portion of central sole element 906, central sole element 907, central sole element 911, central sole element 912, central sole element 913, and central sole element 914.

In some embodiments, recessed portions 920 may have various shapes. In some embodiments, recessed portions 920 may have regular shapes. In other embodiments, recessed portions 920 may have irregular shapes. As shown, recessed portions 920 are formed in tri-star shapes. In some embodiments, the shape of recessed portions 920 may vary along the length of sole structure 900. Additionally, the size of recessed portions 920 may change depending on the location within sole structure 900. For example, in some embodiments, recessed portions 920 may be larger in forefoot region 10 than in heel region 14.

Additionally, in some embodiments, the depth of recessed portions 920 may vary depending on location within sole structure 900. For example, in some embodiments, recessed portions 920 may be deeper in heel region 14 than in forefoot region 10. In such embodiments, recessed portions 920 may provide additional cushioning in heel region 14.

In some embodiments, the shape of recessed portions 920 may align with plurality of sipes 901. For example, recessed portion 921 includes first leg 922, second leg 923, and third leg 924. In some embodiments, a sipe may approximately bisect each of the legs of recessed portion 921. For example, sipe 925 approximately bisects first leg 922, sipe 926 approximately bisects second leg 923, and sipe 927 approximately bisects third leg 924. By bisecting recessed portion 921, sipe 925, sipe 926, and sipe 927 may intersect with one another and approximately align with adjacent recessed portions.

In some embodiments, recessed portions 920 may assist in preventing debris from accumulating along a lower surface of sole structure 900. The difference in elevation or thickness of sole structure 900, including recessed portions 920 and raised portions 903, may prevent debris from accumulating along sole structure 900. Additionally, plurality of sipes 901 may also assist in preventing debris or mud from accumulating along sole structure 900. As sole structure 900 is flexed, debris or mud may be expelled from sole structure 900. Plurality of sipes 901 may contribute to the flexibility of sole structure 900, and raised portions 903 and recessed portions 920 may provide an uneven surface to diminish the amount of debris that may accumulate along sole structure 103. Additionally, raised portions 903 and recessed portions 920 may compress or change shape and size during use. The change in shape or size may force mud or debris to be ejected from sole structure 900. The compression and change in shape may allow for a shear stress to form within mud or debris that accumulates along sole structure 900. The shear stress may increase such that the mud or debris falls off or is ejected from sole structure 900.

Figure 18:
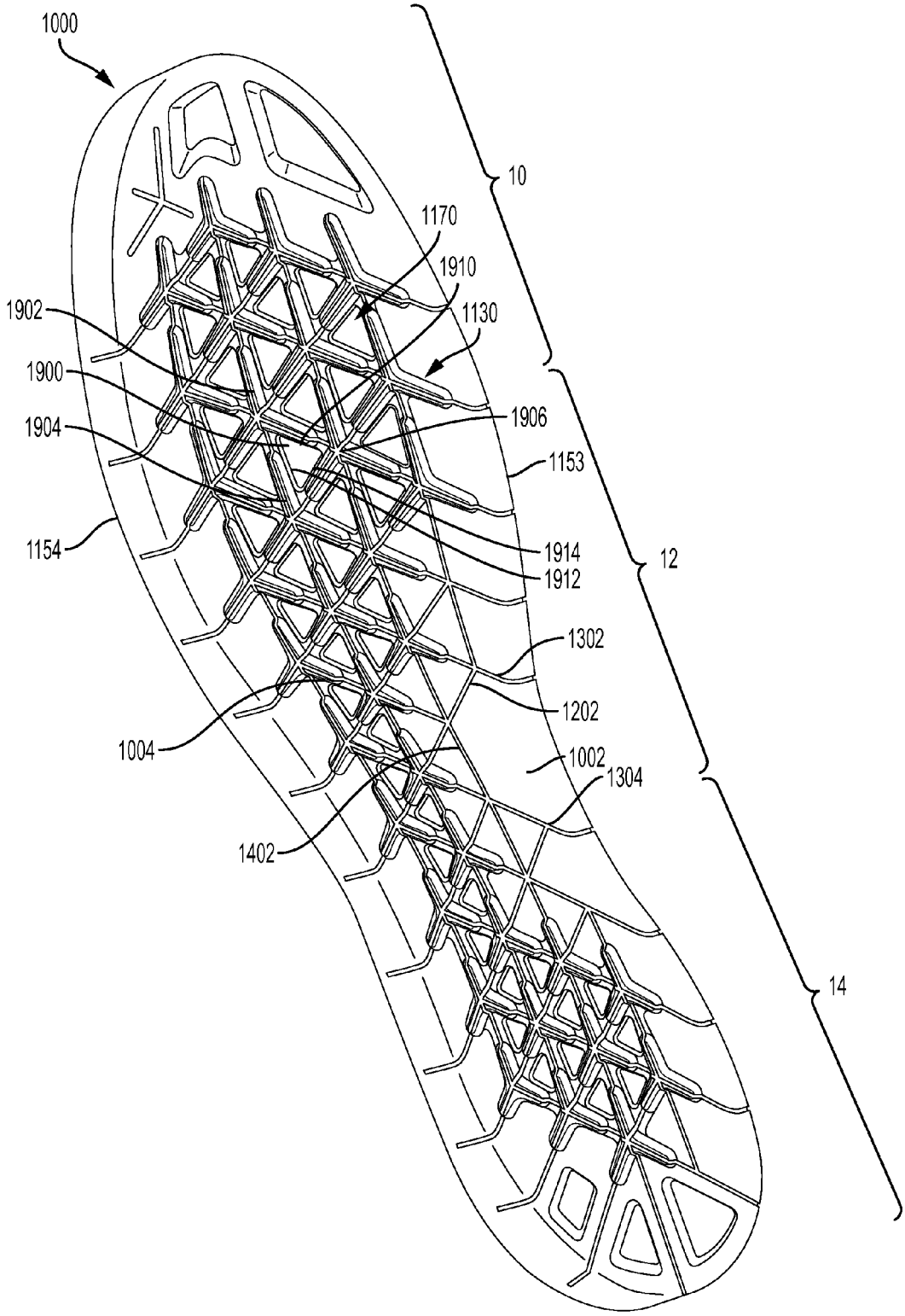
FIG. 18 is a schematic view of another embodiment of a sole structure.

Referring to FIG. 18, an alternate embodiment of a sole structure is depicted. As shown, plurality of sipes 1130 of sole structure 1000 are arranged in a different manner than are plurality of sipes 130 as discussed previously. The different arrangement of plurality of sipes 1130 impacts the shape of sole elements 1170.

Referring particularly to peripheral sole element 1002, peripheral sole element 1002 has a unique shape. The unique shape of peripheral sole element 1002 is impacted by the orientation of plurality of sipes 1130 that border peripheral sole element 1002. In a similar manner as to sole structure 103 discussed above, medial sipe 1302 extends from medial edge 1153 toward lateral edge 1154. Additionally, medial sipe 1304 also extends from medial edge 1153 toward lateral edge 1153. Medial sipe 1302 and medial sipe 1304 extend along peripheral sole element 1002 and therefore define a portion of peripheral sole element 1002. Further, lateral sipe 1202 extends from lateral edge 1154 toward medial edge 1153 in a similar manner as lateral sipes of sole structure 103. Lateral sipe 1202 also forms a boundary or border that extends along peripheral sole element 1002. Further, peripheral sole element 1002 is defined at least in part by longitudinal sipe 1402.

In this configuration, therefore, peripheral sole element 1002 is defined at least in part by a longitudinal sipe, a medial sipe, and a lateral sipe. As shown in the previous figures related to sole structure 103, and as shown in sole structure 1000, generally central sole elements may be defined by a longitudinal sipe, a medial sipe, and a lateral sipe, however, peripheral sole elements may not be defined by each of a longitudinal sipe, a medial sipe, and a lateral sipe. Although as shown in the figures, all three orientations of sipes may intersect one another at a sole element, the borders of the peripheral sole elements a not generally defined by each of the three orientations of sipes. The unique shape of peripheral sole element 1002 may be influenced by interior sipe 1004.

In some embodiments, a sipe may not extend from a medial edge or a lateral edge. That is, in some embodiments, a sipe may be located only within the interior of the sole structure. As shown in FIG. 18, interior sipe 1004 does not extend to lateral edge 1154 or medial edge 1153. Although interior sipe 1004 is generally oriented in the same direction as other medial sipes of sole structure 1000, interior sipe 1004 does not extend to medial edge 1153.

In some embodiments, an interior sipe may intersect with other sipes within a sole structure. As shown in FIG. 18, interior sipe 1004 intersects with lateral sipe 1202 and longitudinal sipe 1402. Further, interior sipe 1004 terminates at this intersection. By terminating at this intersection, interior sipe 1004 may not change the shape of peripheral sole element 1002. In other embodiments, interior sipe 1004 may extend past this intersection and into the interior of peripheral sipe 1002 and therefore influence the shape of peripheral sipe 1002.

In some embodiments, interior sipes may be utilized to form uniquely-shaped sole elements. In some embodiments, interior sipes may be utilized to form larger-sized sole elements. By forming larger-sized sole elements, the rigidity or flexibility of a sole structure may be influenced. For example, as shown in FIG. 18, peripheral sole element 1002 may resist twisting in midfoot region 12 to a greater extent than similarly-situated peripheral sole elements in sole structure 103. By varying the size of sole elements, the rigidity and flexibility of a sole structure may therefore be influenced.

Additionally, as shown in FIG. 18, raised portions may be sized in a different manner than as shown in sole structure 900 of FIGS. 15-17. For example, in some embodiments, a raised portion may extend from a first recessed portion to a second recessed portion. That is, in some embodiments, a sidewall of a raised portion may define a portion of a first recessed portion and a second recessed portion. For example, raised portion 1900 extends between recessed portion 1902, recessed portion 1904, and recessed portion 1906. As shown, therefore, raised portion 1900 extends between, and defines a portion of the sidewall of recessed portion 1902, recessed portion 1904, and recessed portion 1906. For example, first edge 1910 borders recessed portion 1902 and defines a portion of the sidewall of recessed portion 1902. Second edge 1912 borders recessed portion 1904 and defines a portion of the sidewall of recessed portion 1904. Third edge 1914 borders recessed portion 1906 and defines a portion of the sidewall of recessed portion 1906.

Other embodiments of the various sole structures disclosed in the present application may utilize any of the features, provisions, components, functionalities and/or materials that are disclosed in U.S. patent application Ser. No. 14/826,901, filed Aug. 14, 2015 (published as U.S. Patent Publication Number 2017/0042284), titled "Sole Structure Having Auxetic Structures and Sipes," the entirety of which is herein incorporated by reference. Further, other embodiments of the sole structures disclosed in the present application may utilize any of the features, provisions, components, functionalities and/or materials that are disclosed in U.S. patent application Ser. No. 14/826,936, filed Aug. 14, 2015 (published as U.S. Patent Publication Number 2017/0042285), titled "Sole Structures with Regionally Applied Auxetic Openings and Siping," the entirety of which is herein incorporated by reference.

Furthermore, any of the embodiments of the present application could incorporate any of the features, provisions, components, functionalities and/or materials disclosed in any of the following U.S. Applications: U.S. patent application Ser. No. 14/643,121, filed Mar. 10, 2015 (published as U.S. Patent Publication Number 2015/0245686), titled "Sole Structure with Holes Arranged in Auxetic Configuration," the entirety of which is herein incorporated by reference; U.S. patent application Ser. No. 14/643,161, filed Mar. 10, 2015 (published as U.S. Patent Publication Number 2015/0237957), titled "Multi-Component Sole Structure Having an Auxetic Configuration," the entirety of which is herein incorporated by reference; and U.S. patent application Ser. No. 14/643,089, filed Mar. 10, 2015 (published as U.S. Patent Publication Number 2015/0237958), titled "Midsole Component and Outer sole Members with Auxetic Structure," the entirety of which is herein incorporated by reference.

While various embodiments have been described, the description is intended to be exemplary, rather than limiting, and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A sole structure comprising:

a forefoot region, a midfoot region, and a heel region;

the sole structure having a lateral edge and a medial edge, the sole structure further having a toe edge and a heel edge;

a first plurality of sipes;

a second plurality of sipes;

the first plurality of sipes extending from the medial edge of the sole structure toward the lateral edge of the sole structure;

each sipe of the first plurality of sipes extending from a first position along the medial edge to a second position between the medial edge and the lateral edge;

the first position being located closer to the heel edge than the second position;

the second plurality of sipes extending from the lateral edge of the sole structure toward the medial edge of the sole structure;

each sipe of the second plurality of sipes extending from a third position along the lateral edge to a fourth position between the lateral edge and the medial edge;

the third position being located closer to the heel edge than the fourth position;

wherein the first plurality of sipes are located in the forefoot region, the midfoot region, and the heel region; and wherein the second plurality of sipes are located in the forefoot region, the midfoot region, and the heel region.

2. The sole structure according to claim 1, wherein at least one of the first plurality of sipes intersects at least one of the second plurality of sipes at a first intersection.

3. The sole structure according to claim 2, further including a third plurality of sipes, the third plurality of sipes extending from the forefoot region to the heel region, at least one of the third plurality of sipes intersecting with the first plurality of sipes and the second plurality of sipes at the first intersection.

4. The sole structure according to claim 3, wherein the sole structure includes a plurality of sole elements, the plurality of sole elements including a plurality of central sole elements and a plurality of peripheral sole elements, the peripheral sole elements including medial peripheral sole elements and lateral peripheral sole elements, at least one of the medial peripheral sole elements being defined by the medial edge, a first sipe of the first plurality of sipes, a second sipe of the second plurality of sipes, and a third sipe of the third plurality of sipes.

5. The sole structure according to claim 1, wherein fewer than four sipes of the first plurality of sipes extend to the lateral edge of the sole structure.

6. The sole structure according to claim 1, wherein the second plurality of sipes includes a first lateral sipe and a second lateral sipe, the first lateral sipe being substantially parallel to the second lateral sipe.

7. The sole structure according to claim 6, wherein the first lateral sipe is approximately straight.

8. The sole structure according to claim 1, wherein a first lateral sipe is oriented at a first angle with respect to a longitudinal axis, the longitudinal axis extending from the toe edge to the heel edge, and wherein a first medial sipe is oriented at a second angle with respect to the longitudinal axis, and wherein the first angle is different from the second angle.

9. A sole structure comprising:

a forefoot region, a midfoot region, and a heel region;

the sole structure having a first edge and a second edge, the sole structure further having a toe edge and a heel edge;

a first plurality of sipes;

a second plurality of sipes;

a third plurality of sipes;

the first plurality of sipes extending from the first edge of the sole structure toward the second edge of the sole structure;

the first plurality of sipes having a first slope with respect to a longitudinal axis and a lateral axis, the longitudinal axis extending from the toe edge to the heel edge, the lateral axis extending from the first edge to the second edge;

the second plurality of sipes extending from the second edge of the sole structure toward the first edge of the sole structure;

the second plurality of sipes having a second slope with respect to the longitudinal axis;

the second slope being different than the first slope;

the first plurality of sipes intersecting with the second plurality of sipes at a first intersection;

the third plurality of sipes extending from the forefoot region to the heel region;

at least one of the third plurality of sipes intersecting the first plurality of sipes and the second plurality of sipes at the first intersection; and a recessed portion formed into the sole structure such that the first intersection is within the recessed portion.

10. The sole structure according to claim 9, wherein the first edge is a medial edge and the second edge is a lateral edge.

11. The sole structure according to claim 9, wherein the first edge is a lateral edge and the second edge is a medial edge.

12. The sole structure according to claim 9, wherein the second slope is equal and opposite to the first slope.

13. The sole structure according to claim 9, wherein the sole structure includes a plurality of sole elements, the plurality of sole elements including a plurality of central sole elements and a plurality of peripheral sole elements, the peripheral sole elements including medial peripheral sole elements and lateral peripheral sole elements, at least one of the medial peripheral sole elements being defined by a medial edge, a first medial sipe, a second medial sipe, and a first longitudinal sipe.

14. The sole structure according to claim 9, wherein the first plurality of sipes, the second plurality of sipes, and the third plurality of sipes have a first depth in the forefoot region, the first plurality of sipes, the second plurality of sipes, and the third plurality of sipes have a second depth in the heel region, and wherein the first depth is less than the second depth.

15. The sole structure according to claim 9, wherein the sole structure includes a midsole component and an outsole component, the midsole component being made of polyurethane foam.

16. A sole structure comprising:

a forefoot region, a midfoot region, and a heel region;

the sole structure having a lateral edge and a medial edge, the sole structure further having a toe edge and a heel edge;

a first plurality of sipes;

a second plurality of sipes;

a third plurality of sipes;

the first plurality of sipes intersecting the second plurality of sipes and the third plurality of sipes;

the first plurality of sipes, the second plurality of sipes, and the third plurality of sipes forming a plurality of sole elements in the sole structure;

at least one recessed portion being formed in the plurality of sole elements;

the recessed portion having a first leg, a second leg, a third leg, and a central portion;

at least one of the sipes of the first plurality of sipes, at least one of the sipes of the second plurality of sipes, and at least one of the sipes of the third plurality of sipes intersecting in the central portion of the recessed portion;

at least one of the sipes of the first plurality of sipes intersecting the first leg;

at least one of the sipes of the second plurality of sipes intersecting the second leg;

at least one of the sipes of the third plurality of sipes intersecting the third leg;

wherein the first plurality of sipes extend from the medial edge of the sole structure toward the lateral edge of the sole structure;

and wherein the second plurality of sipes extend from the lateral edge of the sole structure toward the medial edge of the sole structure.

17. The sole structure according to claim 16, wherein the sole structure includes a plurality of peripheral sole elements, at least one of the peripheral sole elements including an outsole member, the outsole member corresponding to the shape of at least one peripheral sole element.

18. The sole structure according to claim 16, wherein a portion of the recessed portion extends into a first sole element, a second sole element, a third sole element, a fourth sole element, a fifth sole element, and a sixth sole element.

19. The sole structure according to claim 16, wherein the plurality of sole elements includes a first sole element, the first sole element includes a raised portion, the raised portion corresponding to the shape of the first sole element.

20. The sole structure according to claim 16, wherein the sipes of the first plurality of sipes are substantially parallel to one another along the sole structure from the forefoot region to the heel region.

* * * * *